US005740820A

United States Patent [19]

Stern

[11] Patent Number: 5,740,820

[45] Date of Patent: Apr. 21, 1998

[54] HAIR ROLLERS WITH ENHANCED HAIR ROLLING AND SETTING FEATURES

[75] Inventor: Paule Stern, San Diego, Calif.

[73] Assignee: Madison Star, LLC, San Diego, Calif.

[21] Appl. No.: 710,288

[22] Filed: Sep. 16, 1996

Related U.S. Application Data

[63] Continuation-in-part of Ser. No. 536,936, Sep. 29, 1995.

[51] Int. Cl.[6] ..... A45D 2/16; A45D 2/28

[52] U.S. Cl. ..... 132/249; 132/248; 132/245; 132/263; 132/228

[58] Field of Search ..... 132/228, 226, 132/227, 229, 231, 225, 271, 245, 254, 268, 263, 264, 250

[56] References Cited

U.S. PATENT DOCUMENTS

| | | | |
|---|---|---|---|
| 2,156,948 | 5/1939 | Kayn et al. | 132/264 |
| 2,234,050 | 3/1941 | La Vista | 132/264 |
| 2,244,897 | 6/1941 | Rubina | 132/264 |
| 2,319,658 | 5/1943 | Caldora | 132/250 |
| 2,575,184 | 11/1951 | Moses et al. | 132/264 |
| 3,605,763 | 9/1971 | Fusco | 132/264 |
| 3,916,919 | 11/1975 | Giordano | 132/40 |
| 4,524,788 | 6/1985 | Pauldine | 132/232 |
| 4,526,184 | 7/1985 | Caruso | 132/39 |
| 4,572,221 | 2/1986 | Barradas | 132/33 R |
| 4,603,706 | 8/1986 | Caruso | 132/41 |
| 4,627,452 | 12/1986 | Caruso | 132/33 R |
| 4,974,613 | 12/1990 | Ho | 132/259 |
| 5,000,200 | 3/1991 | Roberts | 132/245 |
| 5,215,107 | 6/1993 | Divner | 132/248 |
| 5,400,810 | 3/1995 | Taylor | 132/232 |
| 5,482,060 | 1/1996 | Barradas | 132/226 |

*Primary Examiner*—Gene Mancene
*Assistant Examiner*—Pedro Philogene
*Attorney, Agent, or Firm*—Flanagan & Flanagan; John R. Flanagan; John K. Flanagan

[57] ABSTRACT

A hair roller includes an elongated body, a hair clip, and an elastic anchoring element. The body has an annular shape around which hair can be wound for styling person's hair. The hair clip has a hair-engagable blade portion and a lever portion. The blade portion is disposed along an exterior side portion of the body and has an arcuate shape conforming to the shape of the body. The lever portion is attached to and extends from the blade portion for actuation by a finger of a user. The roller also has structure mounting the hair clip to the body to undergo pivotal movement along an arcuate path between a closed position adjacent to the body and an opened position angularly displaced from the body such that a portion of the hair is retained between the blade portion of the hair clip and exterior side portion of the body when the hair clip is moved to the closed position in response to a bias imposed on the hair clip and is released from between the blade portion and exterior side portion of the body when the hair clip is pivotally moved toward the opened position in response to the user actuating the lever portion of the hair clip. The elastic element is made of a stretchible material which is extendable longitudinally along the body so as to extend over and thereby anchor thereon the hair wound about the body. The roller also may have a heat retaining member disposed in an interior chamber of the roller body.

68 Claims, 11 Drawing Sheets

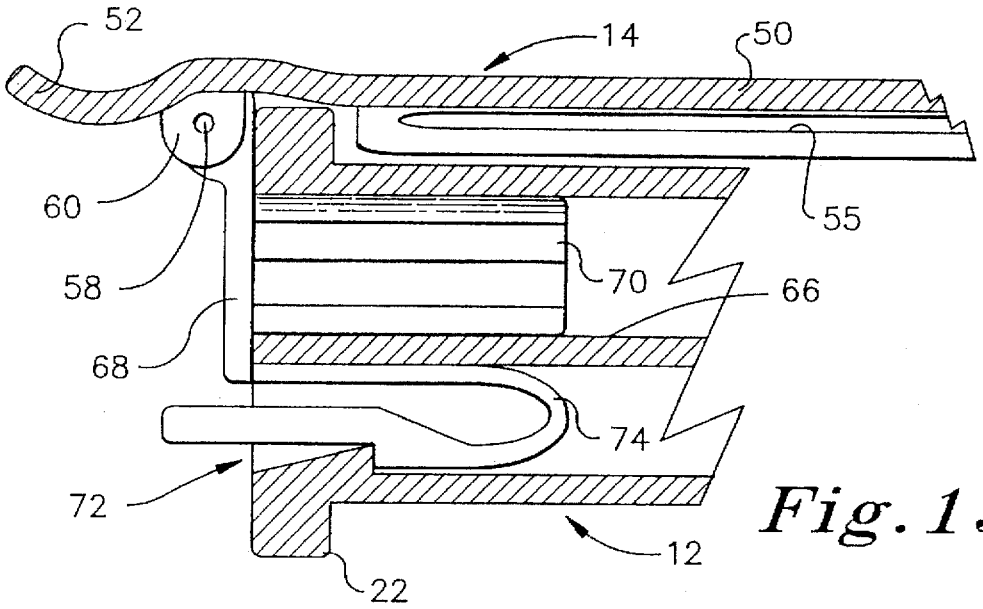
Fig. 13
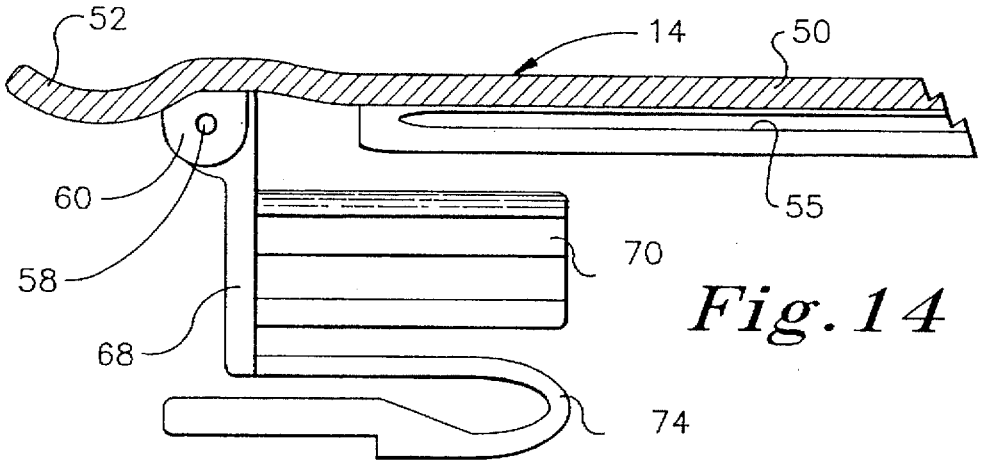
Fig. 14
Fig. 15
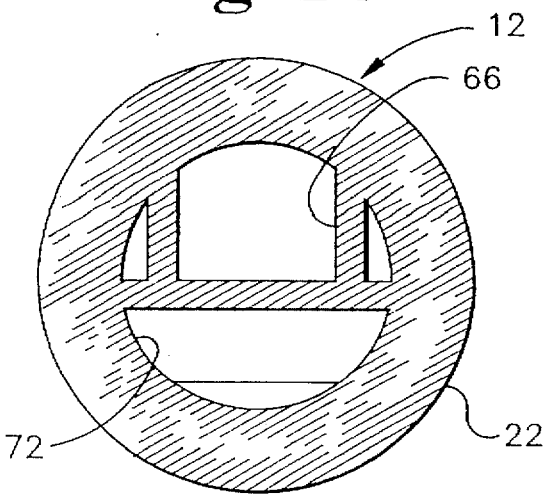
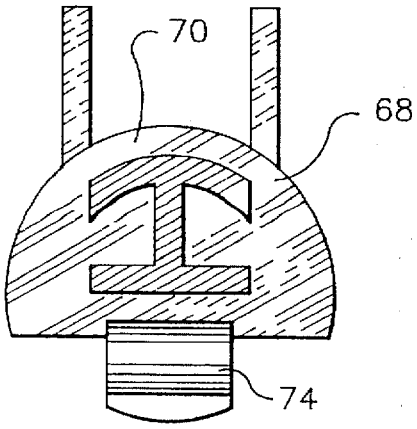
Fig. 16

HAIR ROLLERS WITH ENHANCED HAIR ROLLING AND SETTING FEATURES

CROSS-REFERENCE TO RELATED APPLICATION

This application is a continuation-in-part of U.S. application Ser. No. 08/536,936, filed Sep. 29, 1995 now pending.

BACKGROUND OF THE INVENTION

1. Field of the Invention

The present invention generally relates to hair styling and, more particularly, is concerned with hair rollers for use in hair styling which have enhanced hair rolling and setting features.

2. Description of the Prior Art

A long-established practice of hair dressers and others is to use hair setting rollers to form waves and/or curls in a person's hair in order to achieve the hair style desired by the person. Various designs of hair setting rollers have been used for this purpose.

Representative examples of prior art designs are disclosed in U.S. Pat. No. 3,916,919 to Giordano, U.S. Pat. Nos. 4,526,184, 4,603,706 and 4,627,452 to Caruso, and U.S. Pat. No. 4,974,613 to Ho. A common feature of these prior art hair roller designs is an elongated main body, such as a cylinder or tube, about which hair is rolled and then secured in order to remain wrapped thereon for a desired period of time to allow the hair to set in its wrapped or curled condition. These prior art hair rollers additionally provide a variety of other features which are intended to function in conjunction with the main body to attain optimum hair styling results.

For example, the hair roller of U.S. Pat. No. 3,916,919 combines with its main body a hair holding clip in the form of a pair of resilient fingers or a bent rod, a first rubber band extending through the body and attached to the clip, and a second rubber band extendable longitudinally around the body to retain various parts of the hair roller assembled together and to serve as a preliminary holder of hair against the body. After hair is rolled about the body the first rubber band attached to the clip can be stretched to permit placement and retention of the clip over an edge of the body so as to hold the rolled hair about the body. The second rubber band is retained about the body by passing across recesses formed by a crenelled edge on one end of the body.

The hair rollers of U.S. Pat. Nos. 4,526,184, 4,603,706 and 4,627,452 combine with their main bodies either external projections formed between longitudinal slots in the body to make intimate contact with the hair, arcuate fingers or teeth formed along side edges of the longitudinal slots in the body to catch and comb hair wrapped around the body, or a sleeve of a porous foam material surrounding the body. The hair roller also can have either a separate semi-cylindrical shield with which to handle the roller and to partially surround and retain the wrapped hair on the main body, or a separate or attached hair clip applied over the edge of the main body to embrace a portion of the wrapped hair and retain it thereon.

The hair roller of U.S. Pat. No. 4,974,613 combines with its main body a number of molded-in helically contoured grooves for facilitating winding of hair around the body by providing ridges that grip the hair. The hair roller also has a U-shaped hair clipping device pivotally attached to one end of the body and having a spherical tip which snaps into a groove molded in the opposite end of the body for securing the hair wound around the helical contours on the body.

However, some of the aforementioned features of these prior art hair rollers would appear in practice to create drawback in terms of decreasing the ease with which the hair rollers can be used and of increasing the complexity and thus the cost of the hair rollers. As a result, these prior art hair rollers fail to provide an optimum combination of features which would greatly enhance and facilitate the ability of hair dressers and others to easily and quickly manipulate the hair rollers so as to wrap and set a person's hair in a manner which would minimize the amount of handling of and contact with the hair and thereby maximize the likelihood of achievement of the desired hair styling results.

Consequently, a need still exists for improvements in the design of hair rollers so as to overcome the aforementioned drawbacks of the prior art hair rollers without introducing new drawbacks in their place.

SUMMARY OF THE INVENTION

The present invention provides hair rollers which satisfy the aforementioned needs by incorporating enhanced hair rolling and setting features. The hair rollers of the present invention are user-friendly in terms of ease of manipulation for quickly winding or rolling and thus setting a person's hair to achieved the desired hair styling results.

Accordingly, the present invention is directed to a hair roller which comprises: (a) an elongated body having an annular cross-sectional shape around which hair can be wound between a pair of opposite ends of the body for styling a person's hair; (b) a hair clip having a hair-engagable blade portion disposed longitudinally along and overlying an exterior side portion of the body and of curved cross-sectional shape conforming to the annular cross-sectional shape of the body; and (c) means for mounting hair clip to the body for undergoing pivotal movement relative to the body along an arcuate path between a closed position adjacent to the exterior side portion of the body and an opened position angularly displaced from the exterior side portion of the body such that a portion of the hair is retained between the blade portion of the hair clip and the exterior side portion of the body when the hair clip is at the closed position and is released from between the blade portion of the hair clip and the exterior side portion of the body when the hair clip is pivotally moved toward the opened position. The hair clip further has a lever portion attached to and extending away from at least one of a pair of opposite ends of the blade portion for engagement by a finger of a user to cause pivotal movement of the hair clip from the closed position to the opened position. Preferably, the annular cross-sectional shape of the body is that of a cylinder whereas the curved cross-sectional shape of the blade portion is that of segment of a cylinder. Also, the blade portion of the hair clip has an interior surface facing toward the exterior side portion of the body with a plurality of teeth disposed on and extending outwardly from the interior surface. Alternatively, the body can have an hourglass shape wherein the diameter of the body decreases from the outer ends to the middle thereof. The blade portion of the hair clip would have a curved shape both cross-sectionally and longitudinally that conforms to that of the exterior of the body of the hair roller. Additionally, the exterior side portion of the body of the hair roller which underlies the blade portion of the hair clip can be inwardly offset from the remainder of the body which permits the blade portion to overlie and be seated on the inwardly offset exterior side portion substantially within an exterior annular profile of the body.

More particularly, the mounting means includes a pair of spaced apart tabs disposed adjacent to one of the opposite ends of the body and a pin extending between the tabs and pivotally mounted through an end of the hair clip and a spring mounted to the pin and biasing the hair clip to pivotally move from the opened position to the closed position relative to the body. The body defines an interior chamber and has a plurality of spaced apart openings, such as holes or slots, defined through the body for providing communication from the interior chamber to the hair wound around the body. The mounting means also can include a female socket defined in one of the opposite ends of the body and a base pivotally mounted to one of the opposite ends of the hair clip and having a male plug attached to and projecting outwardly from the base and being of a size relative to the female socket to permit insertion into and a mateable fit with the female socket and thereby mount the base to the one end of the body. The mounting means also can include a latch receptacle defined in the one end of the body adjacent to the female socket and a latch member connected to the base adjacent to the male plug. The latch member is insertable into the latch receptacle upon insertion of the male plug into the female socket. Furthermore, the latch member is movable between a latched position wherein the male plug is retained in the female socket and prevented from being removed therefrom and an unlatched position wherein the male plug is removable from the female socket.

The present invention also is directed to a hair roller which comprises: (a) an elongated body around which hair can be wound between a pair of opposite ends of the body for styling a person's hair; (b) a hair clip extending longitudinally along and overlying an exterior side portion of the body, the hair clip being pivotally connected at one end to one of the opposite ends of the body for undergoing pivotal movement relative to the body along an arcuate path between a closed position adjacent to the exterior side portion of the body and an opened position angularly displaced from the exterior side portion of the body such that a portion of the hair is retained between the hair clip and the exterior side portion of the body when the hair clip is at the closed position and is released from between the hair clip and the exterior side portion of the body when the hair clip is pivotally moved toward the opened position; and (c) an elastic anchoring element made of a stretchible material and being longitudinally extendable along the body between the opposite ends thereof so as to extend over and thereby anchor thereon the hair wound about the body. The elastic anchoring element can be an endless band attached to the body adjacent to one of the opposite ends thereof and extendable about the other of the opposite ends of the body or an elongated strip attached to the body adjacent to the one opposite end and extendable to the other of the opposite ends of the body. The elastic anchoring element can be attached directly to the end of the body or to a looped element fixed on the end of the body. The roller further comprises at least one retention element defined on the other of the opposite ends of the body for securing a portion of the elastic element to the other end of the body. The roller also comprises an end wall mounted to one of the opposite ends of the body with the elastic element being attached to and extending outwardly from the end wall. The end wall may be rotatably mounted to the body.

The present invention further is directed to a hair roller which comprises: (a) an elongated hollow body around which hair can be wound between a pair of opposite ends of said body for styling a person's hair, the elongated body having an interior chamber and a plurality of spaced apart openings defined through the body for providing communication from the interior chamber to the hair wound around the body, the interior chamber of the body being accessible through at least at one end of the body; (b) a hair clip longitudinally extending along and overlying an exterior side portion of the body, the hair clip being connected at one end to the body for undergoing movement relative to the body between a closed position adjacent to the exterior side portion of the body and an opened position displaced from the exterior side portion of the body such that a portion of the hair is retained between the hair clip and the exterior side portion of the body when the hair clip is at the closed position and is released from between the hair clip and the exterior side portion of the body when the hair clip is moved toward the opened position; and (c) a heat retaining member disposed in the interior chamber of the body and being adapted to receive heating producing energy from an external source through the one open end of the body and to retain the heat so produced by the energy for later release to the hair wound around the body during a period of use of the roller.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 13 is a longitudinal sectional view of an end of the elongated body of the hair roller having male and female components shown in side elevational form for removably and mateably fitting the hair clip on the end of the body and latching components for releasably latching the hair clip thereon.

FIG. 14 is a side elevational view of the male plug and latch member attached on a base of the hair clip of the hair roller.

FIG. 15 is a cross-sectional view of the female socket and latch receptacle in the end of the elongated body of the hair roller of FIG. 13.

FIG. 16 is a cross-sectional view of the male plug and latch member of FIG. 14.

DETAILED DESCRIPTION OF THE INVENTION

Figure 1:
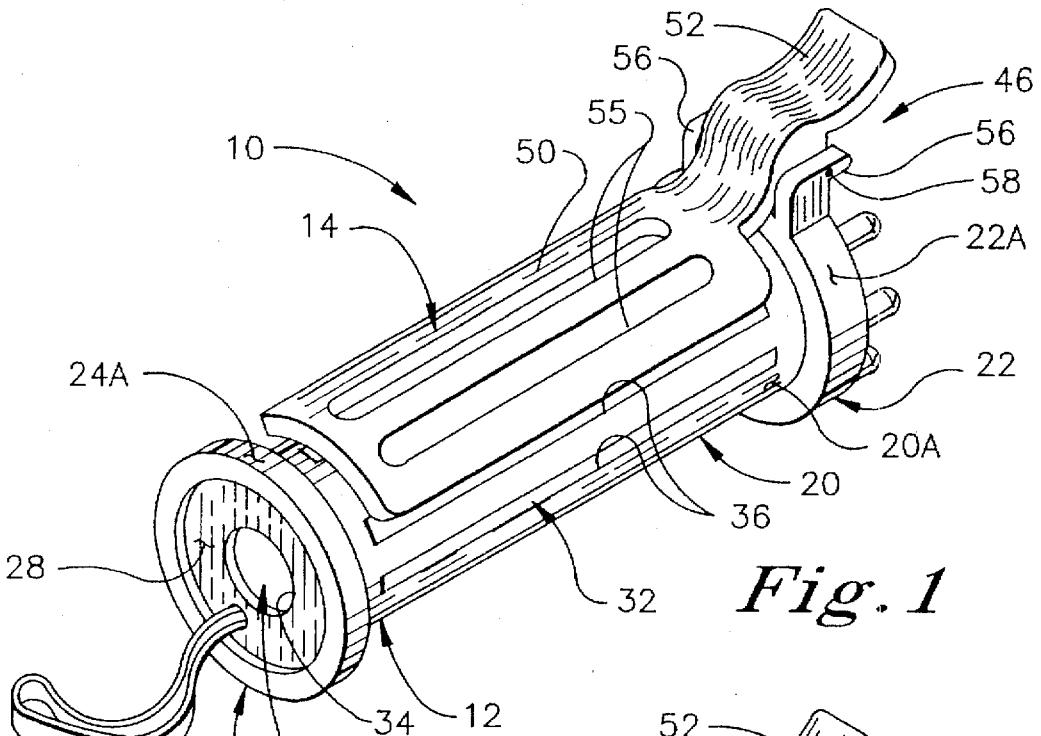
FIG. 1 is a perspective view of the hair roller of the present invention having an elongated body, a hair clip pivotally mounted at one end of the body, and an elastic anchoring element attached at the other end of the body.

Referring to the drawings, and particularly to FIGS. 1, 3A, 5A and 6A, there is illustrated a hair roller of the present invention, generally designated 10, for use in hair styling. The hair roller 10 has enhanced hair rolling and setting features, as described hereinafter, which are user-friendly in terms of ease of manipulation for quickly winding or rolling and thus setting a person's hair to achieved the desired hair styling results. The hair roller 10 is adapted to be employed with and heated by the heating apparatus of the above cross-referenced copending application.

Basically, the hair roller 10 includes an elongated body 12, a hair clip 14 pivotally mounted at one end of the body 12, and an elastic anchoring element 16 which preferably, although not necessarily, is attached at the other end of the body 12. Also, the hair roller 10 preferably, although not necessarily, has a porous outer sleeve 18 preferably made of a flexible spongy foam-like material. The outer sleeve 18 surrounds the body 12 and extends between the opposite ends thereof.

Figure 2:
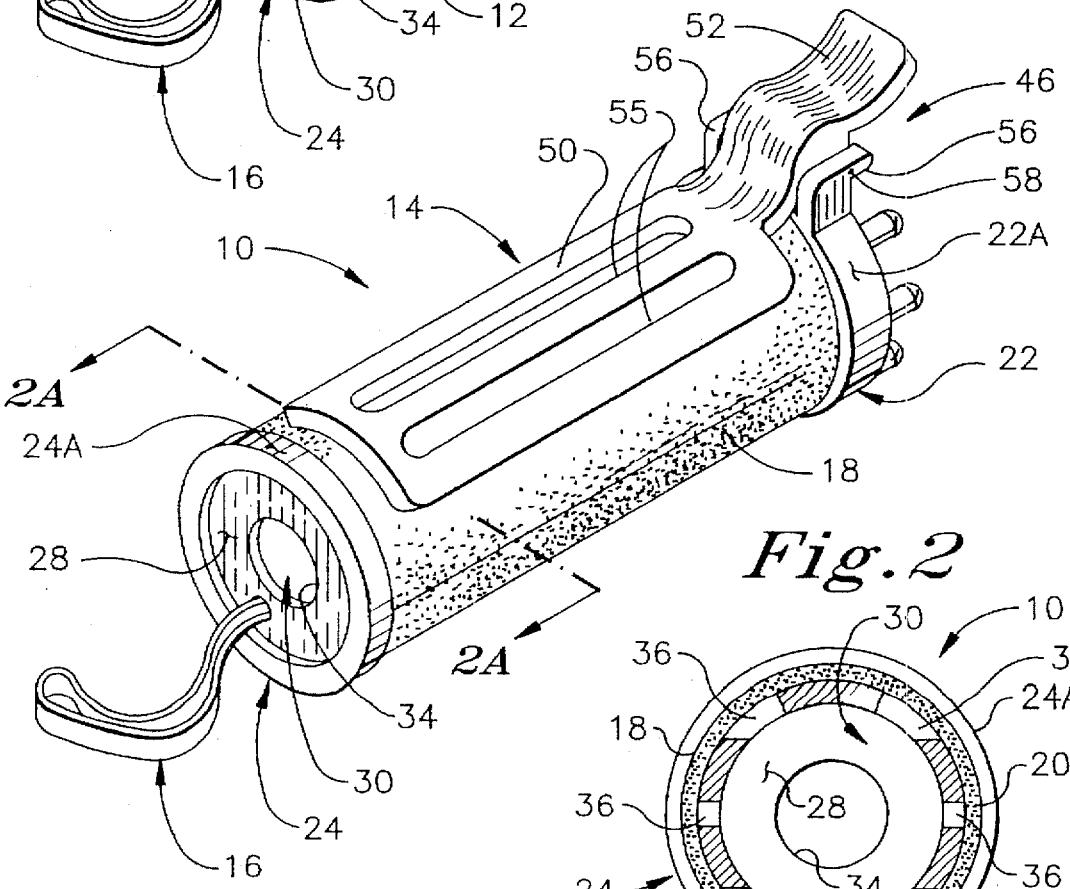
FIG. 2 is a perspective view of the hair roller similar to that of FIG. 1, also having a porous outer sleeve disposed about the elongated body of the roller.
Figure 2A:
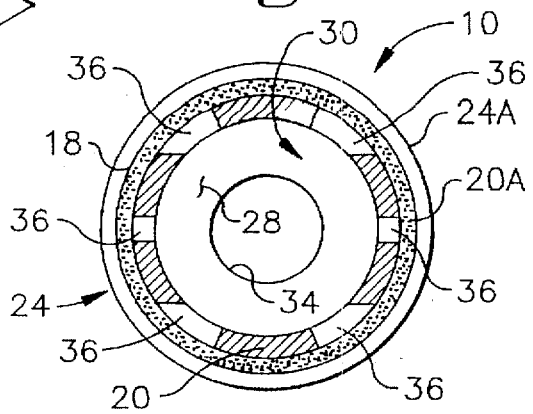
FIG. 2A is an enlarged cross-sectional view of the hair roller taken along line 2A—2A of FIG. 2.

More particularly, the elongated body 12 of the hair roller 10 is preferably hollow and includes an elongated tubular sidewall 20, preferably cylindrical in shape, and a pair of annular rims 22, 24 attached to respective opposite ends of the tubular sidewall 20. The annular rims 22, 24 have outside diameters greater than the outside diameter of the tubular sidewall 20 such that an exterior cylindrical surface 20A of the tubular sidewall 20 is recessed inwardly from exterior annular surfaces 22A, 24A of the annular rims 22, 24. As seen in FIGS. 2 and 2A, the porous outer sleeve 18 is confined in the annular space extending between the annular rims 22, 24 and is seated about the exterior cylindrical surface 20A of the tubular sidewall 20 and extends between the annular rims 22, 24. The tubular sidewall 20 is thus adapted for having hair wound or rolled around it (and thus around the outer sleeve 18 surrounding and overlying the sidewall 20) for setting and thus styling a person's hair.

The elongated body 12 of the hair roller 10 also preferably includes respective opposite end walls 26, 28 connected to the opposite annular rims 22, 24 at the opposite ends of the body 12. Further, the tubular sidewall 20 and opposite end walls 26, 28 of the elongated body 12 define an interior chamber 30 while the tubular sidewall 20 has a plurality of spaced apart openings 32 defined therethrough which provide flow communication of a heated medium, such as air or steam, and liquids and the like from the interior chamber 30 to the porous outer sleeve 18 and thereby to hair wound around the outer sleeve 18 and tubular sidewall 20. At least one of the opposite end walls 26, 28 of the body 12 has an aperture 34 formed therein through which can be inserted a suitable element (not shown) into the interior chamber 30, such as provided by the heating apparatus of the cross-referenced application, in order to supply the heated medium into the interior chamber. The other opposite end wall 26, 28 can be closed.

Figure 3A:
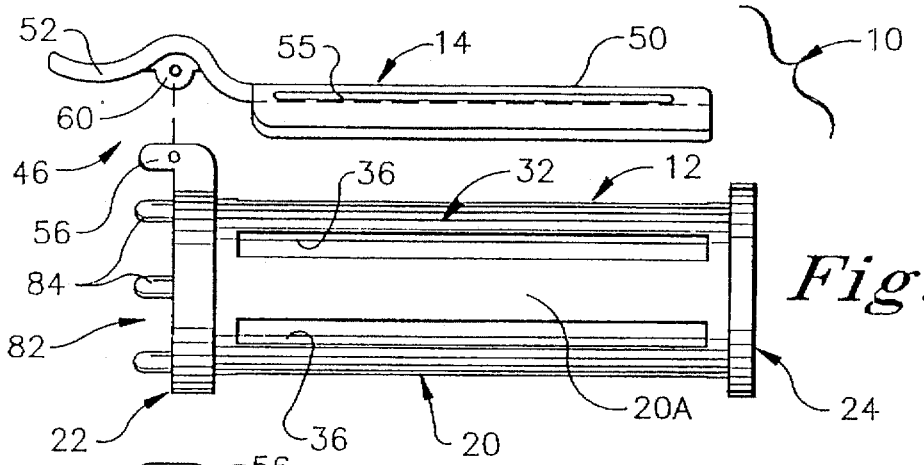
FIG. 3A is a side elevational view of the hair roller of FIG. 1 with the elongated body and hair clip in an exploded relationship, the elongated body having a plurality of slots of a first form in the body, and the elastic anchoring element being omitted.
Figure 3B:
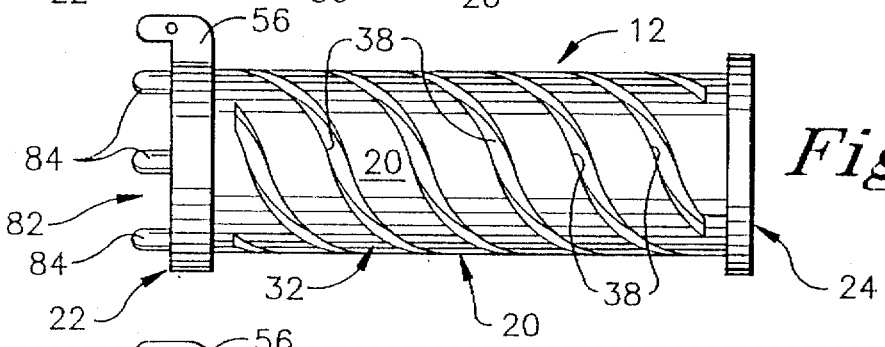
FIG. 3B is a side elevational view of the elongated body of the hair roller having a plurality of helical slots in the body.
Figure 3C:
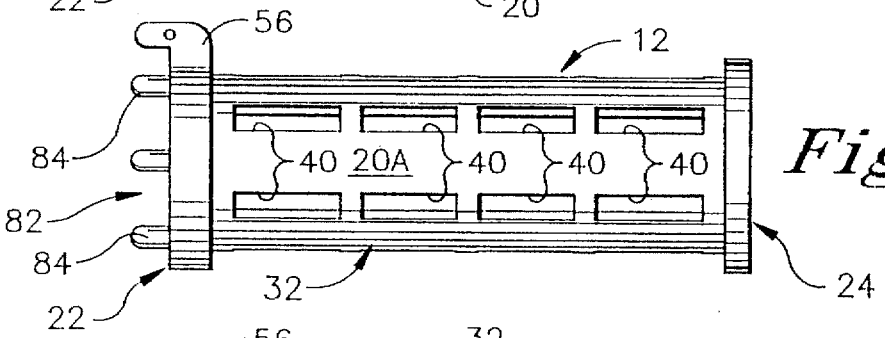
FIG. 3C is a side elevational view of the elongated body of the hair roller having a plurality of slots of a second form in the body.
Figure 3D:
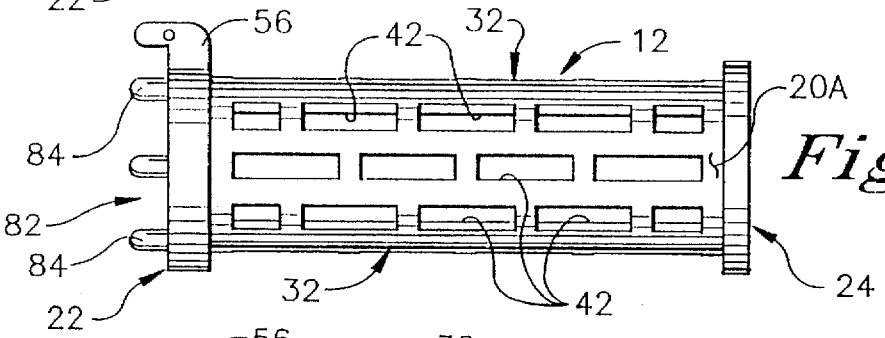
FIG. 3D is a side elevational view of the elongated body of the hair roller having a plurality of slots of a third form in the body.
Figure 3E:
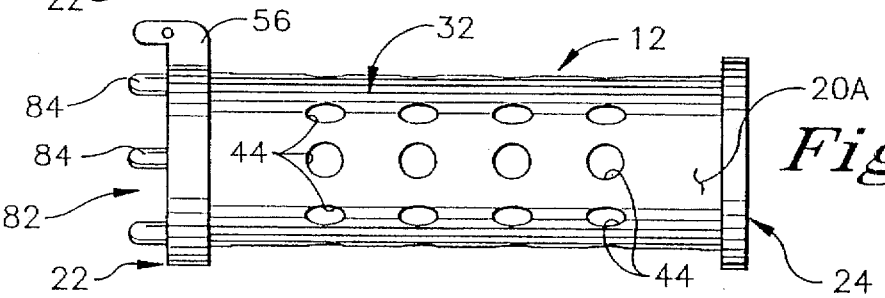
FIG. 3E is a side elevational view of the elongated body of the hair roller having a plurality of holes in the body.
Figure 10:
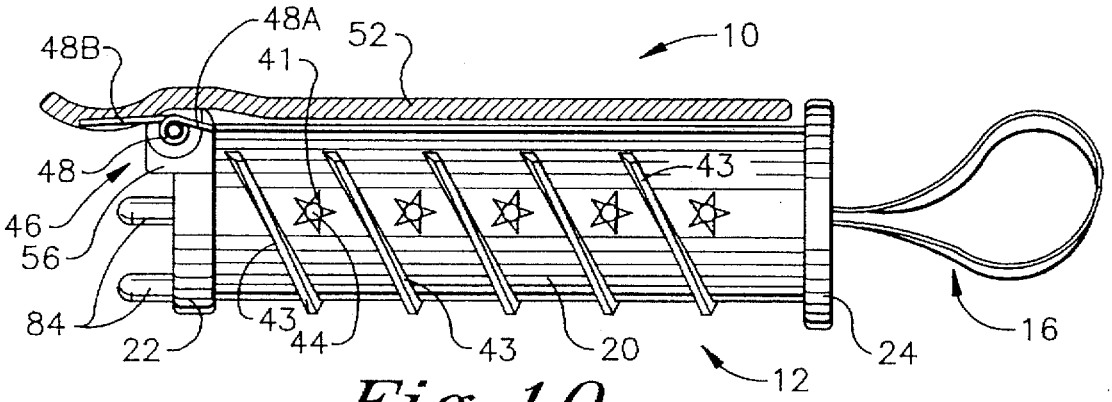
FIG. 10 is a side elevational view of the hair roller having helical ridges formed on the elongated body of the roller.
Figure 11:
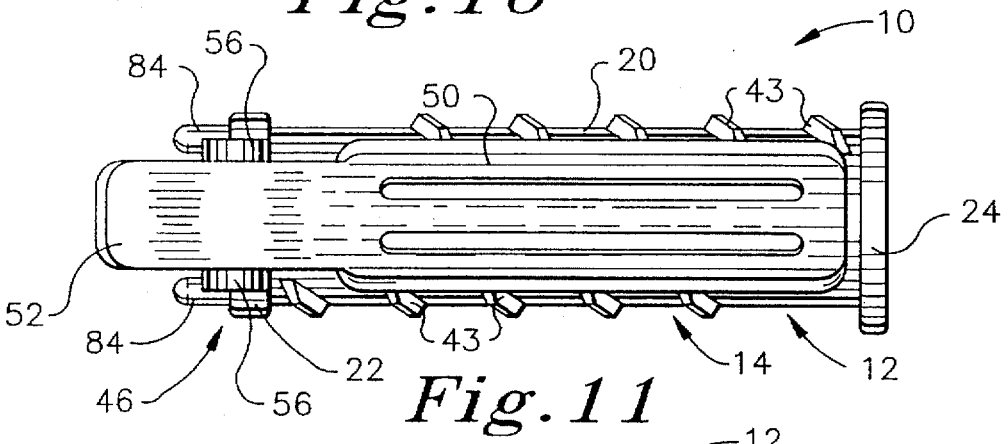
FIG. 11 is a top view of the hair roller as seen along line 11—11 of FIG. 10.
Figure 12:
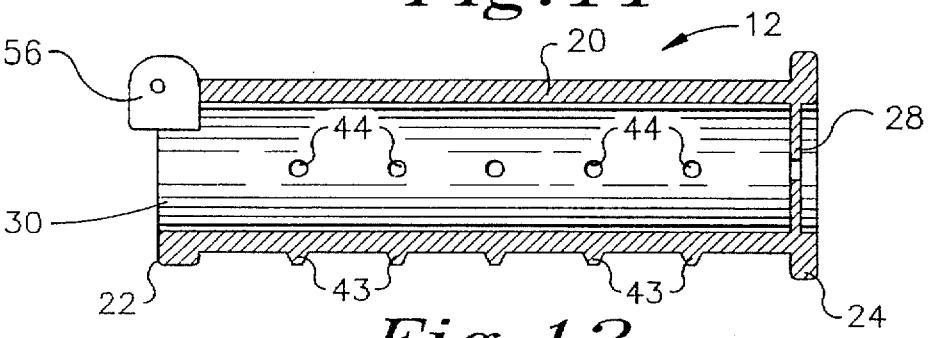
FIG. 12 is a longitudinal sectional view of the elongated body of the hair roller of FIG. 10.

Referring to FIGS. 3A to 3E, there are illustrate different configurations of the openings 32. FIG. 3A (and also FIGS. 1 and 5A–5D) depict a plurality of circumferentially spaced and longitudinal extending substantially full-length slots 36 formed through the sidewall 20 which have generally rectangular shapes. FIG. 3B depicts a plurality of helical slots 38 formed through the sidewall 20 and spaced from one another along a longitudinal axis of the elongated body 12. FIG. 3C depicts a plurality of partial-length slots 40 formed through the sidewall 20 and being of generally rectangular shape and aligned and spaced apart in axial columns and circumferential rows and being much shorter in length than, and thus of partial-length compared to, the full-length slots 36. FIG. 3D depicts a plurality of slots 42 similar to those of FIG. 3C except that the slots 42 in every other axial row are aligned with one another and axially offset relative to the slots 42 in adjacent axial rows. FIG. 3E depicts a plurality of round holes 44 formed through the sidewall 20 and being aligned and spaced apart in axial columns and circumferential rows. Other configurations of the openings 32 are possible within the purview of the present invention. Also, as seen in FIGS. 10–12, the round holes 44 through the sidewall 20 can be overlaid with a variety of raised symbols, such as in the form of stars 41, formed on the exterior surface 20A of the sidewall 20. The tubular sidewall 20 of the body 12 also can have a plurality of elongated raised rib or ridge elements 43 formed on the exterior surface 20A of the sidewall 20 and protruding outwardly therefrom and extending in a helical direction thereabout and being spaced apart from one another in an axial direction along the sidewall 20. The helical ridge elements 43 are interrupted and absent from the exterior side portion of the sidewall 20 underlying the blade portion 50 of the hair clip 14.

Figure 9:
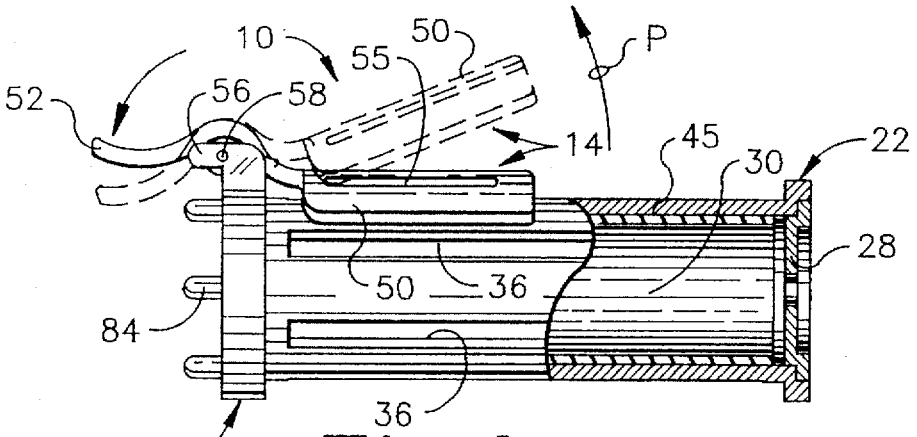
FIG. 9 is a perspective view of the hair roller having a metallic hollow core disposed in the elongated body and a hair clip pivotally mounted at one end of the body and extending therefrom about half of the length of the body.

Furthermore, as seen in FIG. 9, the hair roller 10 can have a metallic sleeve 45 installed within the tubular sidewall 20 for improving conduction of heat to the hair wound around the tubular sidewall 20. The sleeve 45 preferably has a cylindrical shape and is of a size adapted to insert and snugly fit within the interior chamber 30 of the body 12.

Referring now to FIGS. 1, 2, 3A, 5A–5D, 6A, 6B, 7, 10 and 11, there is illustrated the hair clip 14 of the hair roller 10 being mounted to one end of the elongated body 12 by a mounting means 46 for undergoing pivotal movement along an arcuate path P (see FIGS. 5A–5D and 9) between closed and opened positions relative to the body 12, and also being biased to move from the opened position to the closed position by biasing means 48. The closed and opened positions of the hair clip 14 are shown respectively in solid and dashed line forms in both FIGS. 5 and 9.

Figure 6A:
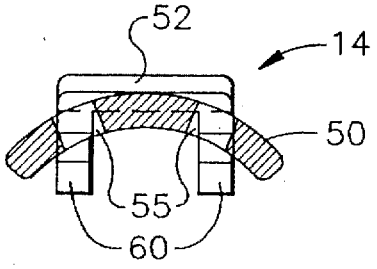
FIG. 6A is an enlarged cross-sectional view of the hair clip of the hair roller.
Figure 6B:
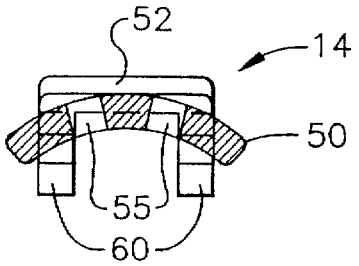
FIG. 6B is another enlarged cross-sectional view of the hair clip of the hair roller.
Figure 17:
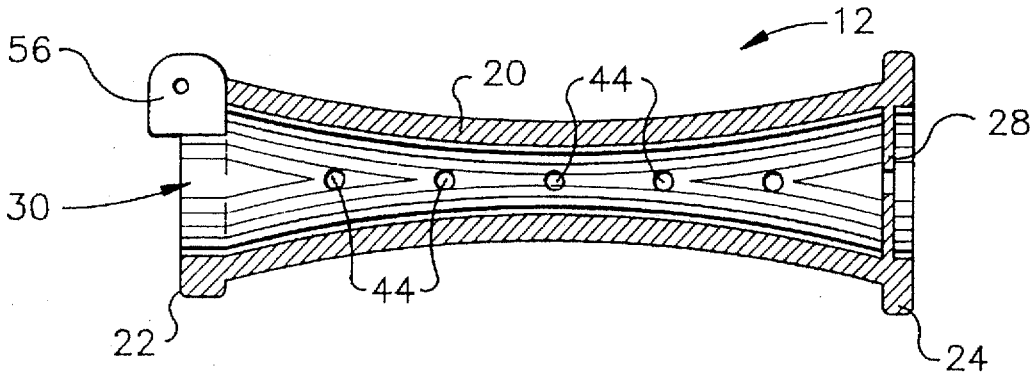
FIG. 17 is a longitudinal sectional view of another embodiment of the elongated body of the hair roller.

Preferably, the hair clip 14 includes a hair-engagable blade portion 50 and at least one lever portion 52. The blade portion 50 of the hair clip 14 is disposed along and overlying an exterior side portion of the tubular sidewall 20 of the body 12. As seen in FIGS. 6A and 6B, the blade portion 50 has an arcuate or curved cross-sectional shape conforming to the annular cross-sectional shape of the tubular sidewall 20 of the body 12. Preferably, the annular cross-sectional shape of the tubular sidewall 20 is that of a cylinder. The arcuate or curved shape of the blade portion 50 is that of an arc falling within a range of from 60° to 120°, and preferably has an approximately 90° or a quarter cylindrical shape, substantially conforming to the 360° cylindrical shape of the tubular sidewall 20 of the body 12. In the closed position of the hair clip 14, the blade portion 50 extends closely along and adjacent to the tubular sidewall 20 of the body 12 substantially the entire distance between the annular rims 22, 24 at the opposite ends of the body 12 such that a portion of the hair is retained between the blade portion 50 and the tubular sidewall 20 of the body 12. In the opened position of the hair clip 14, the blade portion 50 is angularly displaced from the tubular sidewall 20 of the body 12 such that the hair portion is released from between the blade portion 50 of the hair clip 14 and the tubular sidewall 20 of the body 12. Alternatively, as shown in FIG. 9, the blade portion 50 of the hair clip 14 can be provided to extend along the exterior side portion of the tubular sidewall 20 of the body 12 only about half of the distance between opposite annular rims 22, 24 at the opposite ends of the body 12. Also, alternatively, as shown in FIG. 17 the elongated body 12 can have an hourglass shape wherein the diameter of the body 12 decreases from the outer ends to the middle thereof. The blade portion of the hair clip (not shown) would have a curved shape both longitudinally and cross-sectionally that conforms to that of the exterior contour of the body 12 of the hair roller 10.

Figure 7:
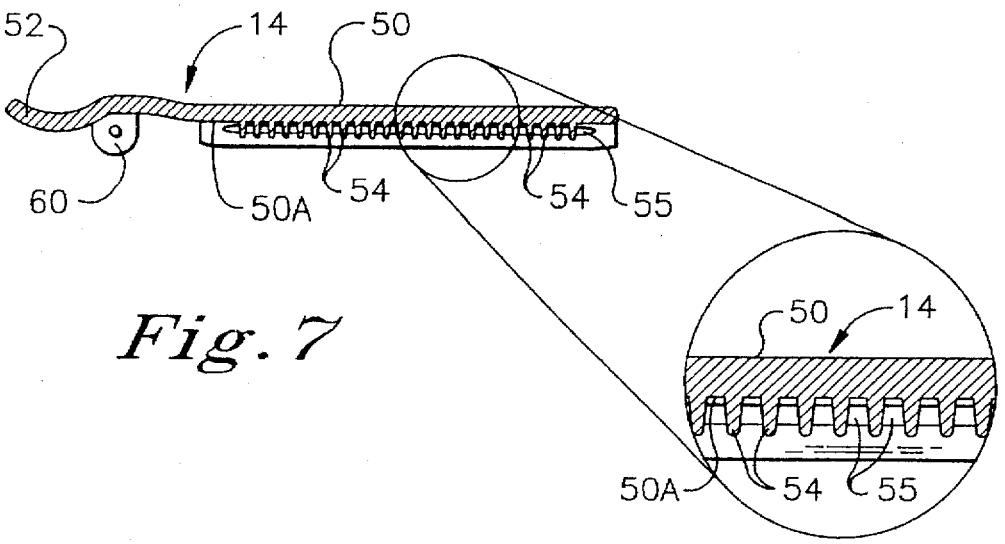
FIG. 7 is a longitudinal sectional view of the hair clip of the hair roller showing details of a section of the hair clip in an enlarged view.

Also, referring to FIG. 7, the blade portion 50 of the hair clip 14 has an interior surface 50A facing toward the exterior side portion of the tubular sidewall 20 of the hair roller body 12 and means thereon in the form of a plurality of teeth 54 formed on and extending outwardly from the interior surface 50A of the blade portion 50. When the hair clip 14 is in its closed position, the teeth 54 interengage the portion of the hair being retained between the blade portion 50 and the tubular sidewall 20 of the body 12 so as to enhance the ability of the hair clip 14 to grip and retain that portion of the hair as the body 12 is then rolled relative to the hair to wind the hair about the tubular sidewall 50. As can readily seen in FIG. 7, the teeth 54 are spaced apart from one another in the longitudinal direction of the blade portion 50 of the hair clip 14 extending between opposite ends of the blade portion. The blade portion 50 of the hair clip also has at least one and preferably a pair of slots 55 defined through the blade portion extending longitudinally between the opposite ends of the blade portion 50. The slots 55 permit passage of liquids and heated medium through the blade portion 50 of the hair clip 14.

Figure 5A:
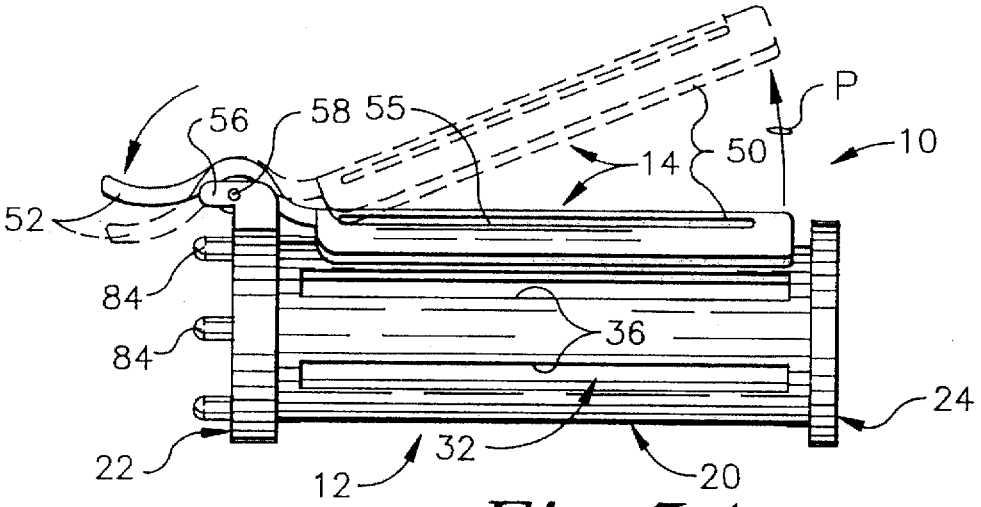
FIG. 5A is a side elevational view of the hair roller of FIG. 1 with the elongated body and hair clip in an assembled relationship and the hair clip shown in a full line form in a closed position adjacent to the elongated body and in a dashed line form in an opened position angularly displaced from the elongated body.
Figure 5B:
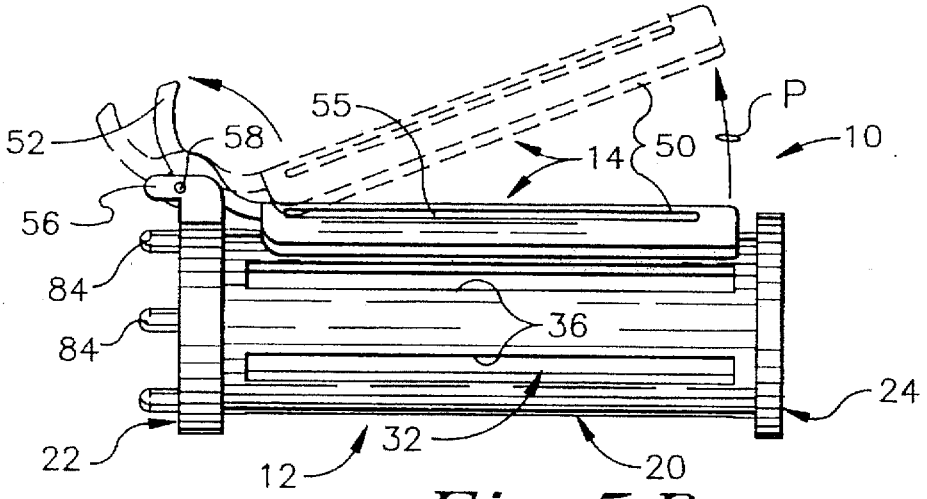
FIG. 5B is a side elevational view of the hair clip and elongated body of the hair roller with the hair clip having a lever portion in a form modified from that of the lever portion shown in FIG. 5A.
Figure 5C:
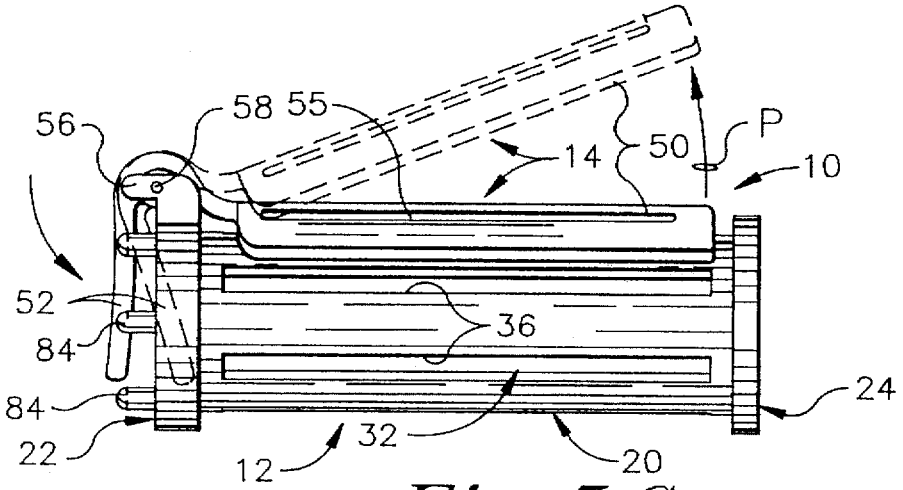
FIG. 5C is a side elevational view of the hair clip and elongated body of the hair roller with the hair clip having a lever portion in another form modified from that of the lever portion shown in FIG. 5B.
Figure 5D:
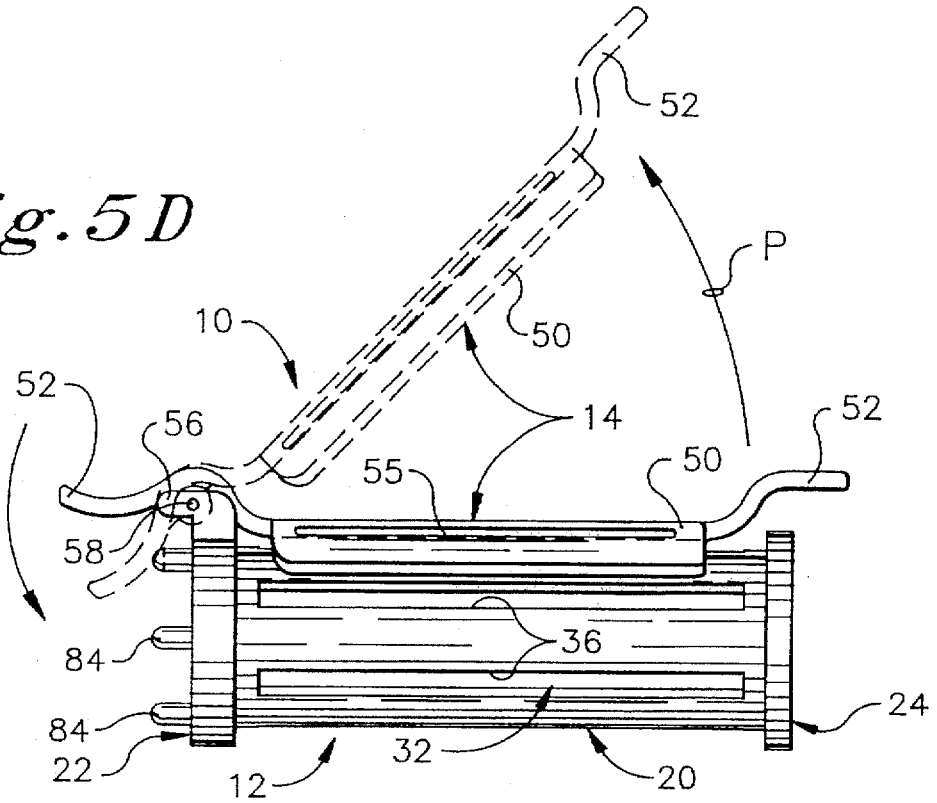
FIG. 5D is a side elevational view of the hair clip and elongated body of the hair roller with the hair clip having a pair of lever portions.

The lever portion 52 of the hair clip 14 is provided to extend outwardly beyond and away from the hair clip mounting means 46 and the adjacent one of the rims 22, 24 at the opposite ends of the body to make it convenient for a user to grip the hair clip 14 with his or her fingers and actuate the hair clip by applying sufficient force thereto to cause hair clip 14 to pivot from its closed to opened position against the force of the biasing means 48 which biases the hair clip 14 to move toward its closed position. It will be readily observed in FIG. 5A that the lever portion so positioned is capable of pivoting through an arc lying wholly outside of the adjacent end of the body 12. As seen in FIGS. 1, 2, 3A, 5A–5D, 7 and 9, the lever portion 52 is provided on at least one end of the hair clip 14 and optionally can be provided on both ends thereof, as shown in FIG. 5D. Furthermore, the lever portion 52 can be provided in various orientations relative to the blade portion 50 of the hair clip 14. For example, as shown in FIGS. 1, 2, 3A, 5A, 5D, 7 and 9, the lever portion 52 can have a slighly upward curved shape and more so curved as shown in FIG. 5B. On the other hand, the lever portion 52 can have a downward turned shaped as shown in FIG. 5C.

Referring now to FIGS. 1, 2, 3A–3E, 5A–5D, 6A, 6B, 7 and 9–11, the mounting means 46 of the hair roller 10 is provided to mount the hair clip 14 adjacent one end of its blade portion 50 to the elongated body 12 at the one annular rim 22 thereof. The hair clip 14 is so mounted to undergo pivotal movement relative to the tubular sidewall 20 along the arcuate path P between the closed position adjacent to the exterior side portion of the sidewall 20 and the opened position angularly displaced from the exterior side portion of the sidewall 20. More particularly, preferably the mounting means 44 includes a pair of spaced apart tabs 56 attached on the exterior annular surface 22A of the one annular rim 22 and extending outwardly therefrom, and a cylindrical pin 58 extending between and mounted to the tabs 56 and rotatably or pivotally mounted through a pair of spaced lugs 60 on the one end of the hair clip 14. Preferably, the annular rim 22 supporting the tabs 56 and pivot pin 58 is non-rotatably fixedly attached to the end of the tubular sidewall 20 of the body 12. However, in one illustrated embodiment shown in FIG. 8E, the annular rim 22 and end wall 26 are attached together and rotatably mounted to the end of the tubular sidewall 20 by mated complementary annular shaped lips 62, 64 formed respectively on the annular rim 22 and the end of the sidewall 20. In this one embodiment, the rotation of the annular rim 22 relative to the sidewall 20 will permit the hair clip 14 to be positioned at any desired angular location about the body 12.

As best seen in FIG. 10, the biasing means 48 preferably is a coiled spring 48 encircling and thus mounted to the pivot pin 58 between the spaced lugs 60 on the hair clip 14. The coiled spring 48 has opposite ends 48A, 48B which engage the body 12 and hair clip 14 and apply a biasing force in a clockwise direction with reference to FIG. 10 that causes the hair clip 14 to pivotally move from the opened position to the closed position relative to the sidewall 20 of the body 12. The user can grip the lever portion 52 of the hair clip 14 and easily apply an actuating force thereto which overcomes the biasing force of the coiled spring 48 and causes the spring to yield and permit pivoting of the hair clip 14 to the opened position. However, once the user releases the lever portion 52 of the hair clip 14, the biasing force takes over and causes the hair clip 14 to then pivotally move from the opened position back to the closed position against the sidewall 20 of the body 12.

Referring to FIGS. 13–16, instead of providing the hair roller 10 with the tabs 56 of the mounting means 46 rigidly attached to the one annular rim 22 on the body 12, as an alternative thereto the mounting means 46 can be configured to be removably inserted into an end of the body 12 for mounting the hair clip 14 thereto. With respect to this alternative construction which is illustrated in FIGS. 13–16, the mounting means 46 now further includes a female socket 66 and a base 68 with a male plug 70, and a latch receptacle 72 and latch member 74. The female socket 66 is defined in the end of the body 12 having the one annular rim 22. The base 68 is pivotally mounted to one end of the hair clip 14 and has the male plug 70 attached thereto and projecting outwardly therefrom. The male plug 70 is of a size slightly less than the size of the female socket 66 so as to permit insertion into and mateable fitting within the female socket 66 and thereby securely mount the base 68 within the annular rim 22 of the end of the body 12.

The latch receptacle 72 is also defined in the end of the body 12 adjacent to the female socket 66. The latch member 74 is flexibly connected to the base 68 adjacent to the male plug 70 and is insertable into the latch receptacle 72 upon insertion of the male plug 70 into the female socket 66. The latch member 74 is movable between a latched position, as seen in FIG. 13, wherein the male plug 70 is retained in the female socket 66 and prevented from being removed therefrom, and an unlatched position wherein the male plug 70 is removable from the female socket 66.

Figure 8A:
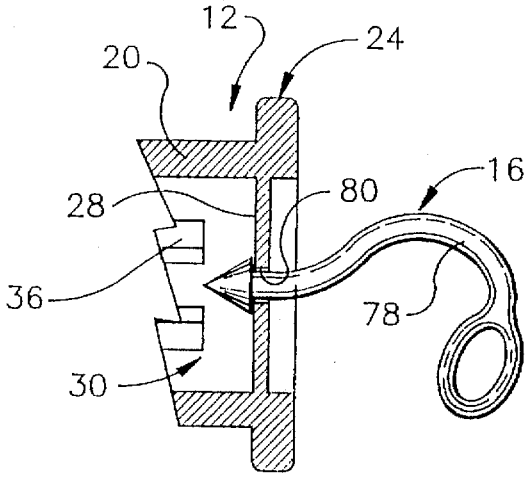
FIG. 8A is a fragmentary longitudinal sectional view of one end of the elongated body of the hair roller having a first form of the elastic anchoring element attached to an end wall of the body.
Figure 8B:
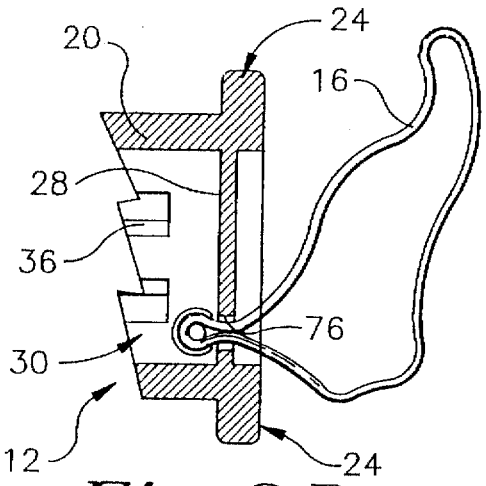
FIG. 8B is a fragmentary longitudinal sectional view of one end the elongated body of the hair roller having a second form of the elastic anchoring element attached to the end wall on the body.
Figure 8C:
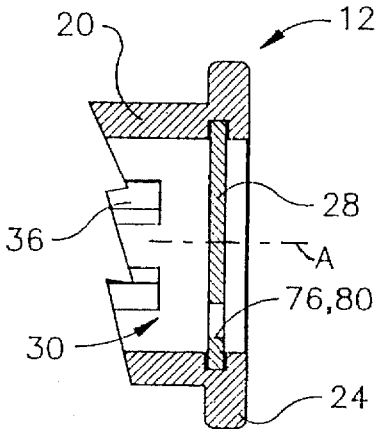
FIG. 8C is a fragmentary longitudinal sectional view of one end of the elongated body of the hair roller similar to that of FIG. 8B with the elastic anchoring element removed from the end wall on the body.
Figure 8D:
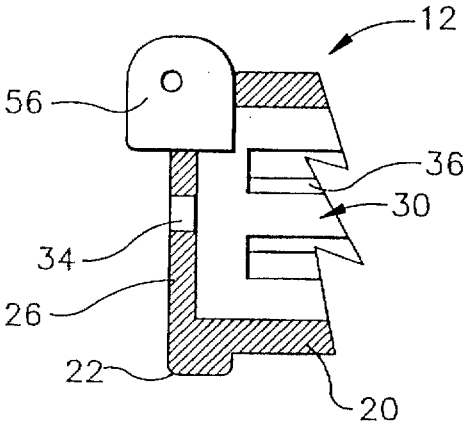
FIG. 8D is a fragmentary longitudinal sectional view of the other end of the elongated body of the hair roller.
Figure 8E:
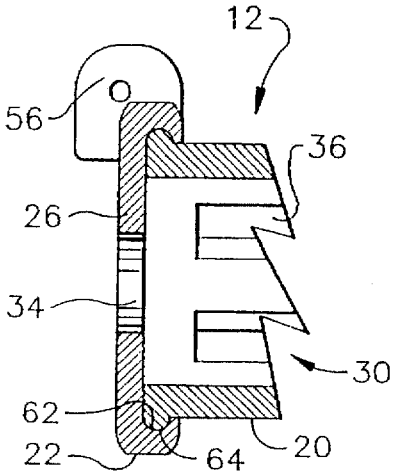
FIG. 8E is another fragmentary longitudinal sectional view of the other end of the elongated body of the hair roller.
Figure 18:
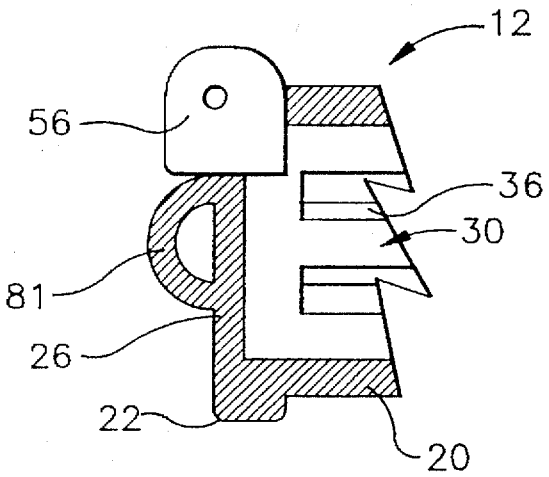
FIG. 18 is a fragmentary longitudinal sectional view of one end of the elongated body of the hair roller having a looped element attached to one end wall of the body.
Figure 19:
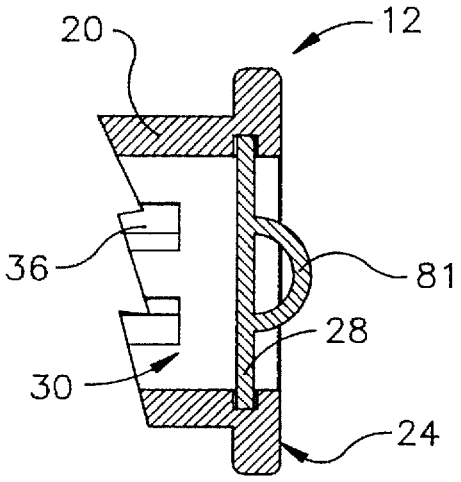
FIG. 19 is a fragmentary longitudinal sectional view of the other end of the elongated body of the hair roller having the looped element attached to the other end wall of the body.
Figure 20:
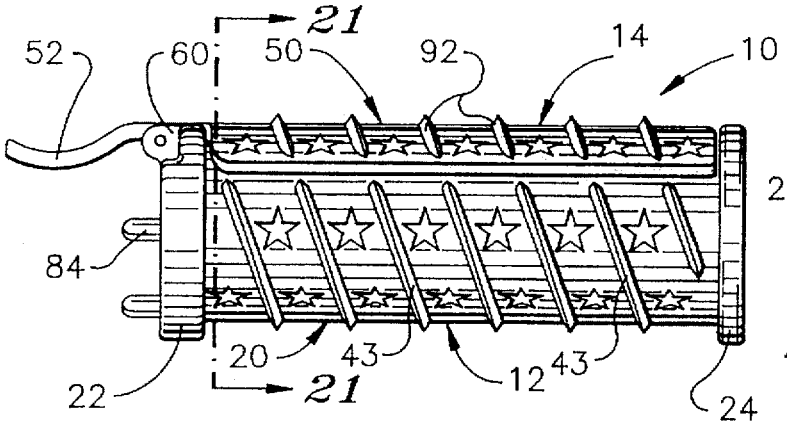
FIG. 20 is a side elevational view of the hair roller similar to that of FIG. 10 but showing the roller having helical ridges formed on both the elongated body and hair clip of the roller.
Figure 21:
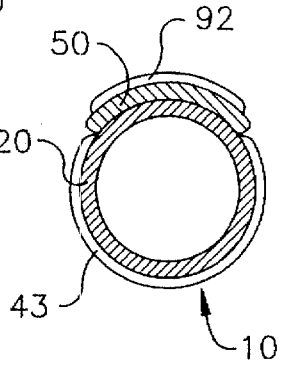
FIG. 21 is a cross-sectional view of the hair roller taken along line 21—21 of FIG. 20.
Figure 22:
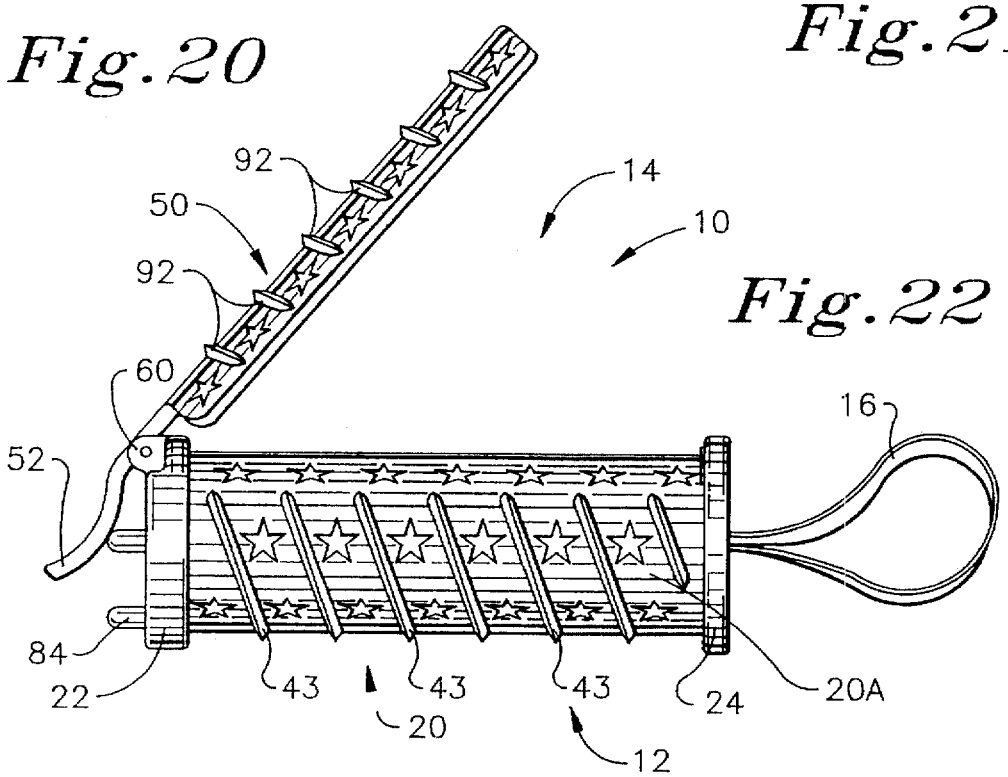
FIG. 22 is a side elevational view of the hair roller of FIG. 20 but showing the hair clip in an opened position relative to the elongated body of the roller and also an elastic anchoring element attached to one end of the elongated body.
Figure 23:
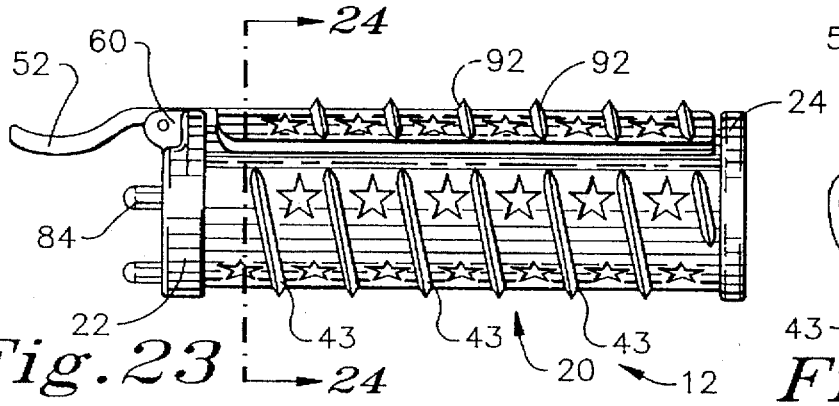
FIG. 23 is a side elevational view of the hair roller similar to that of FIG. 20 but showing the elongated body of the roller having an inwardly offset longitudinal portion permitting the blade portion of the hair clip to seat within the cylindrical profile of the elongated body.
Figure 24:
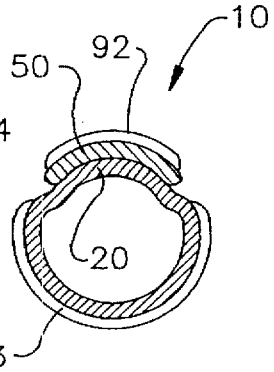
FIG. 24 is a cross-sectional view of the hair roller taken along line 24—24 of FIG. 23.

Referring now to FIGS. 1, 2 and 8A–8D, an elastic hair-anchoring element 16 of the hair roller 10 is made of a stretchible material and is attached to and extends outwardly from the end wall 28. The elastic element 16 is stretchably extendable longitudinally along the sidewall 20 of the body 12 between the annular rims 22, 24 at the opposite ends thereof so as to extend over and thereby anchor thereon the hair wound about the sidewall 20 of the body 12. As seen in FIGS. 1, 2, 8B and 10, the elastic element 16 is an endless elastic loop or band of the material attached to the end wall 28 through a hole 76 therein adjacent to the other rim annular 24. As seen in FIG. 8C, the end wall 28 is mounted for rotation relative to the rim 24 of the body 12 about an axis A and the elastic element 16 is attached to the rotatable end wall 28 at a location of hole 76 offset from the axis of rotation A. As an alternative seen in FIG. 8A, the elastic element can be an elongated elastic strip 78 of the material attached to the end wall 28 through a hole 80 therein. Furthermore, the elastic element 16 can be attached directly to the end wall 28 of the body 12, as depicted in FIGS. 1, 2, 8A and 8B, or to a looped element 81 fixed on one or the other of the end walls 26, 28 of the body 12, as depicted in FIGS. 18 and 19.

Figure 4A:
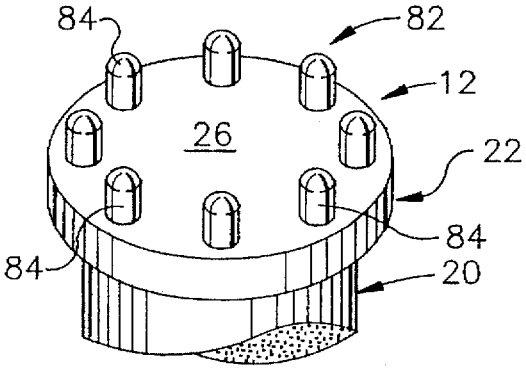
FIG. 4A is a fragmentary perspective view of the elongated body of the hair roller of FIG. 1 having a plurality of retention elements of a first form on the body.
Figure 4B:
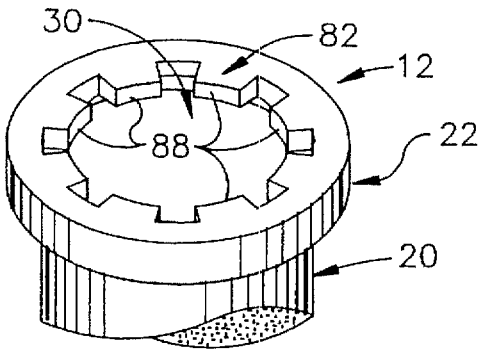
FIG. 4B is a fragmentary perspective view of the elongated body of the hair roller having a plurality of retention elements of a second form on the body.
Figure 4C:
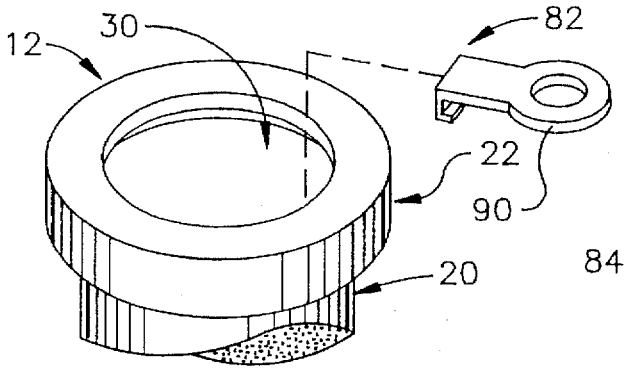
FIG. 4C is a fragmentary perspective view of the elongated body of the hair roller having a plurality of retention elements of a third form on the body.
Figure 4D:
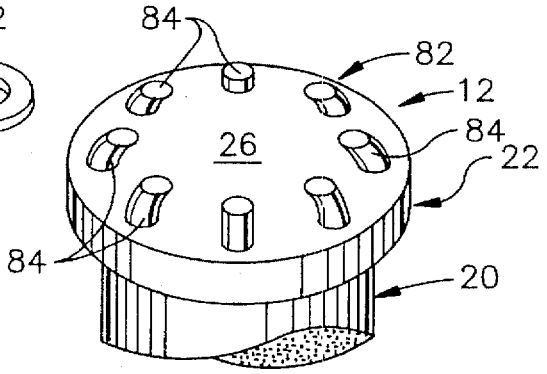
FIG. 4D is a fragmentary perspective view of the elongated body of the hair roller having a plurality of retention elements of a fourth form on the body.
Figure 4E:
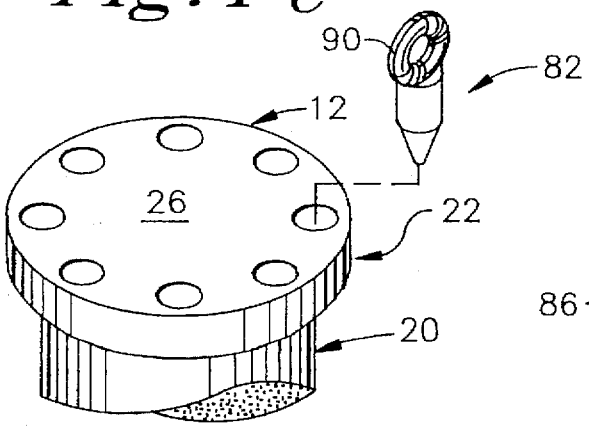
FIG. 4E is a fragmentary perspective view of the elongated body of the hair roller having a plurality of retention elements of a fifth form on the body.
Figure 4F:
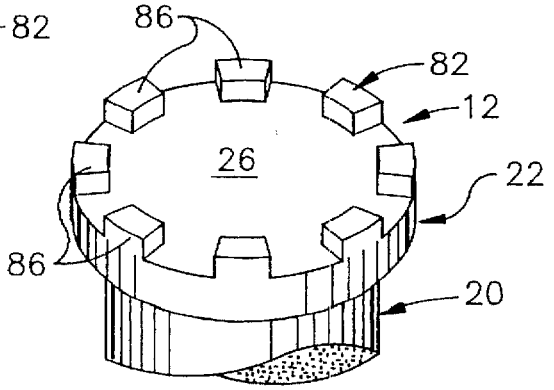
FIG. 4F is a fragmentary perspective view of the elongated body of the hair roller having a plurality of retention elements of a sixth form on the body.

Referring finally to FIGS. 1, 2, 3A–3E, 4A–4F, 5A–5D and 9–11, the hair roller 10 further includes at least one and preferably a plurality of retention elements 82 defined on the other annular rim 24 and end wall 28. The retention elements 82 provide surfaces about which to secure a portion of the elastic element 16 to the opposite end of the body 12. The retention elements can take any of a variety of different configurations. In FIGS. 4A, 4D and 4F the retention elements 82 are pluralities of pegs 84 and teeth 86 which project outwardly from the annular rim 24 on the body 12. FIG. 4B illustrates retention elements 82 in the form of internal teeth 88. FIGS. 4C and 4E depict retention elements in the form of eyelets 90 which are attached to and extend outwardly from the other annular rim 24 and end wall 28.

Retention elements 82 having other configurations are within the purview of the present invention. Thus, the elastic anchoring element 16, being attached at one end to the respective one annular rim 22 and end wall 26 at one end of the body 12, when stretched to encompass at least a side portion of the sidewall 20 of the body 12 and then passed around a selected one or ones of the retention elements 82 is retained over the hair wound around the sidewall 20 and thereby provides a means for anchoring the hair roller 10 to the hair wound thereon.

Referring to FIGS. 20–24, there is shown the hair roller 10 incorporating further modifications of some of the earlier-described components and features of the hair roller 10. First, like the hair roller 10 shown in FIGS. 10–12, the sidewall 20 of the elongated body 12 has a plurality of elongated rib or ridge elements 43 defined on and about the exterior surface 20A of the sidewall 20 which are interrupted and absent from the exterior side portion of the sidewall 20 underlying the blade portion 50 of the hair clip 14. However, unlike the hair roller 10 shown in FIGS. 10–12, the blade portion 50 of the hair clip 14 on the hair roller 10 of FIGS. 20–24 has a plurality of elongated rib or ridge protrusions 92 defined on the exterior surface 50B of the blade portion 50 which protrude outwardly therefrom and extend in a helical direction and are spaced apart from one another in a lengthwise direction along the blade portion 50 of the hair clip 14. Preferably, the helical ridge protrusions 92 on the blade portion 50 of the hair clip 14 are substantially aligned with the helical ridge elements 43 on the sidewall 20 of the body 12. Second, unlike in the sidewalls 20 of the earlier-described hair rollers 10, the exterior side portion of the sidewall 20 of the hair roller 10 in FIGS. 23 and 24 which underlies the blade portion 50 of the hair clip 14 is inwardly offset from the remainder of the sidewall 20 which permits the blade portion 50 of the hair clip 14 to overlie and be seated on the inwardly offset exterior side portion substantially within an exterior profile of the sidewall 50 of the body 12. In the case of the body 12 of the hair roller 10 shown in FIGS. 23 and 24, the exterior annular profile is that of a cylinder. The insetting of the blade portion 50 of the hair clip 14 within the exterior annular outline or profile of the hair roller body 12 prevents the hair clip 14 from make an impression or indentation in the hair wound about the body 12.

Figure 25:
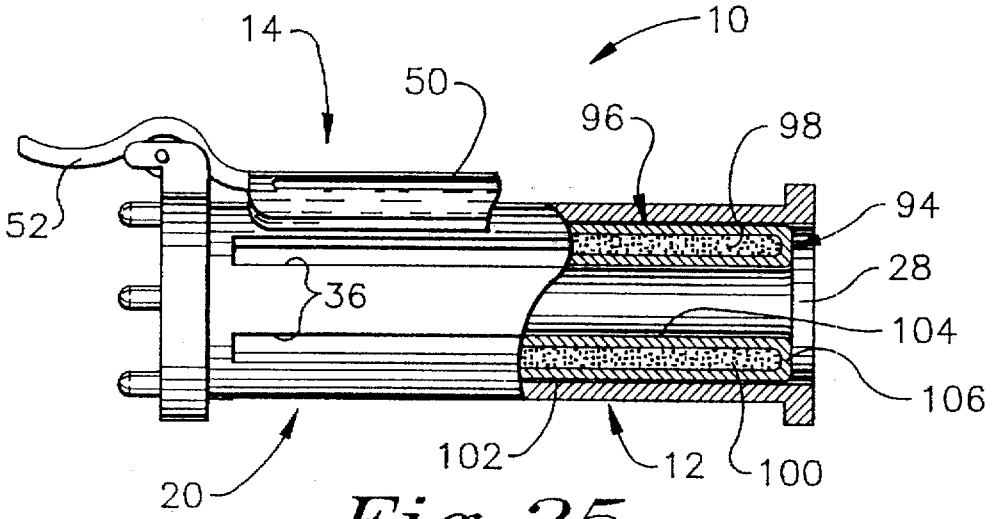
FIG. 25 is a partially cutaway side elevational view of a hair roller containing one embodiment of a heat retaining member therein.
Figure 26:
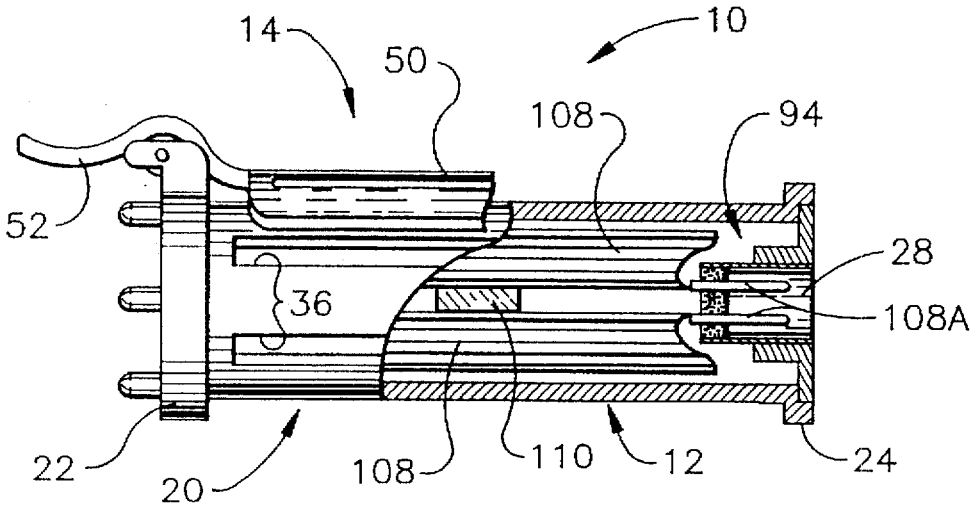
FIG. 26 is a partially cutaway side elevational view of a hair roller containing another embodiment of a heat retaining member therein.

Referring to FIGS. 25 and 26, there is shown other embodiments of the hair roller 10 incorporating additional features in accordance with the present invention. The hair rollers 10 of FIGS. 25 and 26 have the same basic parts as most of the rollers described earlier. These same parts are identified by the same reference numerals. In addition thereto, the hair rollers 10 of FIGS. 25 and 26 also include a heat retaining member 94 disposed in the interior chamber 30 of the roller body 12. The heat retaining member 94 is adapted to receive heat producing energy, such as steam in FIG. 25 or electrical current in FIG. 26, from a suitable external source through the one open end 28 of the body 12 and to retain the heat so produced by the energy for later release to the hair wound around the body 12 during a following period of use of roller 10.

In the one embodiment shown in FIG. 25, the heat retaining member 94 includes an annular tube 96 having a donut shape in cross-section defining an enclosed internal cavity 98 and a heat retaining material 100, such as a suitable wax or the like, contained within and substantially filling the internal cavity 98. The annular tube 96 has radially spaced outer and inner longitudinal walls 102, 104 and a pair of opposite end walls 106 (only one being seen) extending between and interconnecting the opposite ends of the longitudinal walls 102, 104 so as to enclose the internal cavity 98 and the heat retaining material 100 therein. The inside of the annular tube 96 is accessible to the one open end 28 of the body 12 for receiving the steam to cause heating of the annular tube 96 and the wax 100 therein.

In the other embodiment shown in FIG. 26, the heat retaining member 94 includes a pair of electrical conductors 108, preferably made of a suitable metallic material, having a pair of electrical terminals 108A at one end that are accessible to the one open end 28 of the body 12 and a heat retaining material 110, such as an electrically-conductive ceramic material known as a Positive Temperature Coefficient material, in electrical contact between the pair of electrical conductors 108. The application of an electrical current from the suitable external source to the terminals 108A causes the current to flow through the electrical conductors 108 and also through the heat retaining material 110 such that the heat retaining material 110 is thereby heated and, in turn, causes heating of the electrical conductors 108 which then retain the heat for later release to the hair wound around the body 12 during a following period of use of roller 10.

It should be readily apparent that the hair roller 10 can be provided in different diameter sizes while retaining all of the above-described features which provide for enhanced rolling and setting of hair for achieving superior hair styling results. Furthermore, the hair roller 10 can be employed in conjunction with the heating apparatus of the cross-referenced patent application or independently thereof.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A hair roller, comprising:

(a) an elongated body having an annular cross-sectional shape around which hair can be wound between a pair of opposite ends of said body for styling a person's hair;

(b) a hair clip having a hair-engagable blade portion disposed longitudinally along and overlying an exterior side portion of said body and of curved cross-sectional shape conforming to said annular cross-sectional shape of said body;

(c) pivot means mounted at a first of said opposite ends of said body for mounting said hair clip to said body for undergoing pivotal movement relative to said body along an arcuate path between a closed position adjacent to said exterior side portion of said body and an opened position angularly displaced from said exterior side portion of said body such that a portion of the hair is retained between said blade portion of said hair clip and said exterior side portion of said body when said hair clip is at said closed position and is released from between said blade portion of said hair clip and said exterior side portion of said body when said hair clip is pivotally moved toward said opened position; and (d) said hair clip having a lever portion extending from said pivot means beyond and away from said first of said opposite ends of said body for facilitating engagement by a finger of a user to cause pivotal movement of said lever portion through an arc wholly outside of said first end of said body and thereby pivotal movement of said hair clip from said closed position to said open position.

2. The roller of claim 1 wherein said annular cross-sectional shape of said body is that of a cylinder, whereas said curved cross-sectional shape of said blade portion of said hair clip is that of an arc falling within a range of from 60° to 120°.

3. The roller of claim 1 wherein said lever portion is attached to and extends away from at least one of a pair of opposite ends of said blade portion.

4. The roller of claim 1 wherein said hair clip extends along said exterior side portion of said body substantially the entire distance between said opposite ends of said body.

5. The roller of claim 1 wherein said hair clip extends along said exterior side portion of said body only about half of the distance between said opposite ends of said body.

6. The roller of claim 1 wherein said blade portion of said hair clip has at least one slot defined through said blade portion extending longitudinally between a pair of opposite ends of said hair clip.

7. The roller of claim 1 wherein said body defines an interior chamber and has a plurality of spaced apart openings defined through said body providing communication from said interior chamber to the hair wound around said body.

8. The roller of claim 7 wherein said openings are holes defined through said body being spaced apart from one another in axial and circumferential directions along and about said body.

9. The roller of claim 7 wherein said openings are elongated slots defined through said body, said slots extending in an axial direction along said body and being spaced apart from one another in a circumferential direction about said body.

10. The roller of claim 7 wherein said openings are elongated slots defined through said body, said slot extending in a helical direction about said body and being spaced apart from one another in an axial direction along said body.

11. The roller of claim 1 wherein said annular cross-sectional shape of said body is an hourglass shape wherein said body has a diameter decreasing from said opposite outer ends to a middle thereof.

12. The roller of claim 1 wherein said exterior side portion of said body is inwardly offset from the remainder of said body permitting said blade portion of said hair clip overlying said exterior side portion to be seated substantially within an exterior annular profile of said body.

13. The roller of claim 1 wherein said lever portion is angled upwardly in a direction away from said body.

14. The roller of claim 1 wherein said body has an interior chamber and a plurality of spaced apart openings defined through said body for providing communication from said interior chamber to hair wound around said body, said interior chamber of said body being accessible through at least one end thereof.

15. The roller of claim 14, further comprising:

a heat retaining member disposed in said interior chamber of said body and adapted to receive heating producing energy from an external source through said one end of said body and to retain the heat so producted by the energy for later release to hair wound around said body during a following period of use of said roller.

16. The roller of claim 15 wherein said heat retaining member includes:

an annular tube accessible to said one end of said body and having a donut shape in cross-section defining an enclosed internal cavity; and a heat retaining material contained within said enclosed internal cavity of said annular tube.

17. The roller of claim 15 wherein the heat retaining member includes:

a pair of electrical conductors having a pair of electrical terminals accessible to said one end of said body; and an electrically conductive heat retaining material disposed in electrical contact between said pair of electrical conductors such that application of an electrical current to said terminals passes the current through said electrical conductors and said heat retaining material such that said heat retaining member is thereby heated and causes heating of said electrical conductors which retain the heat for later release to the hair wound around said body during a following period of use of said roller.

18. A hair roller, comprising:

(a) an elongated body having an annular cross-sectional shape around which hair can be wound between a pair of opposite ends of said body for styling a person's hair;

(b) a hair clip having a hair-engagable blade portion disposed longitudinally along and overlying an exterior side portion of said body and of curved cross-sectional shape conforming to said annular cross-sectional shape of said body, said blade portion of said hair clip having an interior surface facing toward said exterior side portion of said body and a plurality of teeth disposed on and extending outwardly from said interior surface, said teeth being spaced apart from one another in a longitudinal direction extending between a pair of opposite ends of said blade portion of said hair clip; and (c) means for mounting said hair clip to said body for undergoing pivotal movement relative to said body along an arcuate path between a closed position adjacent to said exterior side portion of said body and an opened position angularly displaced from said exterior side portion of said body such that a portion of the hair is retained between said blade portion of said hair clip and said exterior side portion of said body when said hair clip is at said closed position and is released from between said blade portion of said hair clip and said exterior side portion of said body when said hair clip is pivotally moved toward said opened position.

19. A hair roller, comprising:

(a) an elongated body having an annular cross-sectional shape around which hair can be wound between a pair of opposite ends of said body for styling a person's hair;

(b) a hair clip having a hair-engagable blade portion disposed longitudinally along and overlying an exterior side portion of said body and of curved cross-sectional shape conforming to said annular cross-sectional shape of said body; and (c) means for mounting said hair clip to said body for undergoing pivotal movement relative to said body along an arcuate path between a closed position adjacent to said exterior side portion of said body and an opened position angularly displaced from said exterior side portion of said body such that a portion of the hair is retained between said blade portion of said hair clip and said exterior side portion of said body when said hair clip is at said closed position and is released from between said blade portion of said hair clip and said exterior side portion of said body when said hair clip is pivotally moved toward said opened position, said mounting means including a pair of spaced apart tabs disposed adjacent to one of said opposite ends of said body and a pin extending between said pair of tabs and pivotally mounted through an end of said hair clip.

20. The roller of claim 19 wherein said mounting means further includes a spring mounted to said pin and biasing said hair clip to pivotally move from said opened position to said closed position relative to said body.

21. The roller of claim 19 wherein said mounting means further includes an annular rim rotatably mounted to said one of said opposite ends of said body, said tabs being attached to and extending outwardly from said annular rim.

22. A hair roller, comprising:

(a) an elongated body having an annular cross-sectional shape around which hair can be wound between a pair of opposite ends of said body for styling a person's hair, said body having a plurality of elongated ridge elements defined on an exterior surface of said body protruding outwardly therefrom and extending in a helical direction about said body and spaced apart from one another in an axial direction along said body;

(b) a hair clip having a hair-engagable blade portion disposed longitudinally along and overlying an exterior side portion of said body and of curved cross-sectional shape conforming to said annular cross-sectional shape of said body; and (c) means for mounting said hair clip to said body for undergoing pivotal movement relative to said body along an arcuate path between a closed position adjacent to said exterior side portion of said body and an opened position angularly displaced from said exterior side portion of said body such that a portion of the hair is retained between said blade portion of said hair clip and said exterior side portion of said body when said hair clip is at said closed position and is released from between said blade portion of said hair clip and said exterior side portion of said body when said hair clip is pivotally moved toward said opened position.

23. The roller of claim 22 wherein said blade portion of said hair clip has a plurality of elongated ridge protrusions defined on an exterior surface of said blade portion protruding outwardly therefrom and extending in a helical direction and spaced apart from one another in an axial direction along said blade portion of said hair clip.

24. The roller of claim 23 wherein said ridges elements on said exterior surface of said body are interrupted and absent from said exterior side portion of said body underlying said blade portion of said hair clip.

25. The roller of claim 23 wherein said helical ridge protrusions on said exterior surface of said blade portion of said hair clip are substantially aligned with said helical ridge elements on said exterior surface of said body.

26. A hair roller, comprising:

(a) an elongated body having an annular cross-sectional shape around which hair can be wound between a pair of opposite ends of said body for styling a person's hair;

(b) a hair clip having a hair-engagable blade portion disposed longitudinally along and overlying an exterior side portion of said body and of curved cross-sectional shape conforming to said annular cross-sectional shape of said body; and (c) means for mounting said hair clip to said body for undergoing pivotal movement relative to said body along an arcuate path between a closed position adjacent to said exterior side portion of said body and an opened position angularly displaced from said exterior side portion of said body such that a portion of the hair is retained between said blade portion of said hair clip and said exterior side portion of said body when said hair clip is at said closed position and is released from between said blade portion of said hair clip and said exterior side portion of said body when said hair clip is pivotally moved toward said opened position, wherein said mounting means includes a female socket defined in one of said opposite ends of said body and a base pivotally mounted to one of said opposite ends of said hair clip and having a male plug attached to and projecting outwardly from said base and being of a size relative to said female socket to insert into and mateably fit within said female socket and thereby mount said base to said one end of said body.

27. The roller of claim 26 wherein said mounting means further includes:

a latch receptacle defined in said one end of said body adjacent to said female socket; and a latch member connected to said base adjacent to said male plug and insertable into said latch receptacle upon insertion of said male plug into said female socket, said latch member being mowable between a latched position wherein said male plug is retained in said female socket and prevented from being removed therefrom and an unlatched position wherein said male plug is removable from said female socket.

28. A hair roller, comprising:

(a) an elongated body having an annular cross-sectional shape around which hair can be wound between a pair of opposite ends of said body for styling a person's hair;

(b) a hair clip having a hair-engagable blade portion disposed longitudinally along and overlying an exterior side portion of said body and of curved cross-sectional shape conforming to said annular cross-sectional shape of said body;

(c) means for mounting said hair clip to said body for undergoing pivotal movement relative to said body along an arcuate path between a closed position adjacent to said exterior side portion of said body and an opened position angularly displaced from said exterior side portion of said body such that a portion of the hair is retained between said blade portion of said hair clip and said exterior side portion of said body when said hair clip is at said closed position and is released from between said blade portion of said hair clip and said exterior side portion of said body when said hair clip is pivotally moved toward said opened position; and (d) a porous outer sleeve surrounding said body and extending between said opposite ends of said body.

29. A hair roller, comprising:

(a) an elongated body having an annular cross-sectional shape around which hair can be wound between a pair of opposite ends of said body for styling a person's hair;

(b) a hair clip having a hair-engagable blade portion disposed longitudinally along and overlying an exterior side portion of said body and of curved cross-sectional shape conforming to said annular cross-sectional shape of said body;

(c) means for mounting said hair clip to said body for undergoing pivotal movement relative to said body along an arcuate path between a closed position adjacent to said exterior side portion of said body and an opened position angularly displaced from said exterior side portion of said body such that a portion of the hair is retained between said blade portion of said hair clip and said exterior side portion of said body when said hair clip is at said closed position and is released from between said blade portion of said hair clip and said exterior side portion of said body when said hair clip is pivotally moved toward said opened position; and (d) an elastic hair-anchoring element made of a stretchible material and being extendable longitudinally along said body between said opposite ends thereof so as to extend over and thereby anchor thereon the hair wound about said body.

30. The roller of claim 29 further comprising:

an end wall mounted to one end of said body, said elastic element being attached to and extending outwardly from said end wall.

31. The roller of claim 30 wherein said end wall is rotatably mounted to said one end of said body.

32. The roller of claim 29 further comprising:

an end wall mounted to one end of said body; and a looped element mounted to said end wall, said elastic element being attached to and extending outwardly from said looped element.

33. A hair roller, comprising:

(a) an elongated body around which hair can be wound between a pair of opposite ends of said body for styling a person's hair;

(b) a hair clip extending longitudinally along and overlying an exterior side portion of said body, said hair clip being pivotally connected at one end to one of said opposite ends of said body for undergoing pivotal movement relative to said body along an arcuate path between a closed position adjacent to said exterior side portion of said body and an opened position angularly displaced from said exterior side portion of said body such that a portion of the hair is retained between said hair clip and said exterior side portion of said body when said hair clip is at said closed position and is released from between said hair clip and said exterior side portion of said body when said hair clip is pivotally moved toward said opened position; and (c) an elastic, hair-anchoring element made of stretchible material and being extendable longitudinally along said body between said opposite ends thereof so as to extend over and thereby anchor thereon the hair wound about said body.

34. The roller of claim 33 wherein said elastic element is an endless band of said material attached to said body adjacent to one of said opposite ends thereof and extendable about said other of said opposite ends of said body.

35. The roller of claim 33 wherein said elastic element is an elongated strip of said material attached to said body adjacent to one of said opposite ends thereof and extendable to said other of said opposite ends of said body.

36. The roller of claim 33 further comprising:

at least one retention element defined on the other of said opposite ends of said body for securing a portion of said elastic element to said other end of said body.

37. The roller of claim 36 wherein said retention element is at least one peg projecting outwardly from said other end of said body.

38. The roller of claim 36 wherein said retention element is at least one tooth formed in said other end of said body.

39. The roller of claim 36 wherein said retention element is at least one eyelet attached to and extending outwardly from said other end of said body.

40. The roller of claim 33 further comprising:

an end wall mounted to one of said opposite ends of said body, said elastic element being attached to and extending outwardly from said end wall.

41. The roller of claim 40 wherein said end wall is rotatably mounted to said one end of said body.

42. A hair roller, comprising:

(a) an elongated body having first and second opposite ends, a sidewall defining an interior chamber and having an annular shape around which hair can be wound for styling a person's hair, and an end wall mounted to said first opposite end of said body, said sidewall extending between and connected to said first and second opposite ends and having a plurality of spaced apart openings defined therethrough providing communication from said interior chamber to the hair wound around said sidewall;

(b) a hair clip having a hair-engagable blade portion and a lever portion, said blade portion being disposed along and overlying an exterior side portion of said body and having an arcuate shape conforming to said annular shape of said body, said lever portion attached to and extending away from one of a pair of opposite ends of said blade portion for actuation by a finger of a user; and (c) means for mounting said hair clip adjacent one end of said blade portion thereof to said second end of said body to undergoing pivotal movement relative to said sidewall of said body along an arcuate path between a closed position adjacent to said exterior side portion of said sidewall of said body and an opened position angularly displaced from said exterior side portion of said sidewall of said body such that a portion of the hair is retained between said blade portion of said hair clip and said exterior side portion of said sidewall of said body when said hair clip is at said closed position and is released from between said blade portion of said hair clip and said exterior side portion of said sidewall of said body when said hair clip is pivotally moved toward said opened position in response to the user actuating said lever portion of said hair clip;

(d) means engaging said hair clip and said body for biasing said hair clip to pivotally move from said opened position to said closed position relative to said sidewall of said body in response to the user releasing said lever portion of said hair clip; and (e) an elastic hair-anchoring element made of a stretchible material and being attached to and extending outwardly from said end wall, said elastic element being extendable longitudinally along said sidewall of said body between said first and second opposite ends thereof so as to extend over and thereby anchor thereon the hair wound about said sidewall of said body.

43. The roller of claim 42 wherein said blade portion of said hair clip extends along said exterior side portion of said sidewall of said body substantially the entire distance between said first and second opposite ends of said body.

44. The roller of claim 42 wherein said blade portion of said hair clip extends along said exterior side portion of said sidewall of said body only about half of the distance between said first and second opposite ends of said body.

45. The roller of claim 42 wherein said blade portion of said hair clip has an interior surface facing toward said exterior side portion of said sidewall of said body and a plurality of teeth disposed on and extending outwardly from said interior surface, said teeth being spaced apart from one another in a longitudinal direction extending between opposite ends of said blade portion of said hair clip.

46. The roller of claim 42 wherein said mounting means includes a pair of spaced apart tabs attached to said second opposite end of said body and a pin extending between said tabs and pivotally mounted through an end of said hair clip.

47. The roller of claim 46 wherein said biasing means includes a spring mounted to said pin and biasing said hair clip to pivotally move from said opened position to said closed position relative to said sidewall of said body.

48. The roller of claim 42 wherein said mounting means includes:

a female socket defined in said second opposite end of said body; and a base pivotally mounted to one end of said hair clip and having a male plug attached to and projecting outwardly from said base and being of a size relative to said female socket to insert into and mateably fit within said female socket and thereby mount said base to said second opposite end of said body.

49. The roller of claim 48 wherein said mounting means further includes:

a latch receptacle defined in said second opposite end of said body adjacent to said female socket; and a latch member connected to said base adjacent to said male plug and insertable into said latch receptacle upon insertion of said male plug into said female socket, said latch member being movable between a latched position wherein said male plug is retained in said female socket and prevented from being removed therefrom and an unlatched position wherein said male plug is removable from said female socket.

50. The roller of claim 42 further comprising:

a porous outer sleeve surrounding said body and extending between said first and second opposite ends of said body.

51. The roller of claim 42 wherein said end wall is rotatably mounted to said first opposite end of said body.

52. The roller of claim 42 wherein said elastic. element is an endless band of said material attached to said end wall adjacent to said first opposite end of said body and being extendable about said second opposite end of said body.

53. The roller of claim 42 wherein said elastic element is an elongated strip of said material attached to said end wall adjacent to said first opposite end of said body and being extendable to said second opposite end of said body.

54. The roller of claim 42 further comprising:

at least one retention element defined on said second opposite end of said body for securing a portion of said elastic element to said second opposite end of said body.

55. The roller of claim 54 wherein said retention element is at least one peg projecting outwardly from said second opposite end of said body.

56. The roller of claim 54 wherein said retention element is at least one tooth formed in said second opposite end of said body.

57. The roller of claim 54 wherein said retention element is at least one eyelet attached to and extending outwardly from said second opposite end of said body.

58. The roller of claim 42 wherein on of said first and second opposite ends of said body is closed.

59. The roller of claim 42 further comprising:

a metallic sleeve having an annular shape and being sized to insert and fit within said interial chamber of said body.

60. The roller of claim 42 wherein said blade portion of said hair clip has a plurality of elongated ridge protrusions defined on an exterior surface of said blade portion protruding outwardly therefrom and extending in a helical direction and spaced apart from one another in an axial direction along said blade portion of said hair clip.

61. The roller of claim 60 wherein said ridges elements on said exterior surface of said body are interrupted and absent from said exterior side portion of said body underlying said blade portion of said hair clip.

62. The roller of claim 60 wherein said helical ridge protrusions on said exterior surface of said blade portion of said hair clip are substantially aligned with said helical ridge elements on said exterior surface of said body.

63. The roller of claim 42 wherein said exterior side portion of said sidewall of said body is inwardly offset from the remainder of said sidewall permitting said blade portion of said hair clip overlying said exterior side portion to be seated substantially within an exterior annular profile, of said sidewall of said body.

64. A hair roller, comprising:

(a) an elongated body around which hair can be wound between opposite first and second ends of said body for styling a person's hair;

(b) a rotatable element rotatably mounted at said first end of said body; and (c) an elastic hair-anchoring element in the form of a band of stretchable material attached to said rotatable element at said first end of said body and extendable longitudinally along said body to said second end thereof and securable at said second end of said body to thereby anchor thereon the hair wound about said body.

65. The roller of claim 64 wherein said rotatable element is mounted for rotation about an axis and said band is attached to said rotatable member at a location offset from said axis of rotation.

66. The roller of claim 64 further comprising:

at least one retention member mounted at said second end of said body about which said elastic band is securable.

67. The roller of claim 66 further comprising:

a plurality of retention members mounted in a circular arrangement at said second end of said body.

68. The roller of claim 67 wherein each of said retention members is a peg projecting outwardly from said body.

* * * * *